US008840219B2

(12) United States Patent
Chiwata et al.

(10) Patent No.: US 8,840,219 B2
(45) Date of Patent: Sep. 23, 2014

(54) IMAGE FORMING APPARATUS

(71) Applicant: Fujifilm Corporation, Tokyo (JP)

(72) Inventors: Yuhei Chiwata, Kanagawa (JP); Masuharu Inui, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/011,760

(22) Filed: Aug. 28, 2013

(65) Prior Publication Data

US 2014/0071197 A1 Mar. 13, 2014

(30) Foreign Application Priority Data

Sep. 10, 2012 (JP) ..... 2012-198701

(51) Int. Cl.
*B41J 29/377* (2006.01)
*B41J 2/01* (2006.01)

(52) U.S. Cl.
USPC ..... 347/18; 347/101; 347/102

(58) Field of Classification Search
CPC ..... B41J 11/002; B41J 11/0015; B41J 29/377
USPC ..... 347/18, 101, 102
See application file for complete search history.

(56) References Cited

U.S. PATENT DOCUMENTS 6,092,891 A * 7/2000 Okubo et al. ..... 347/104
2010/0225720 A1* 9/2010 Ishida ..... 347/102
2013/0044169 A1* 2/2013 Chiwata ..... 347/102

FOREIGN PATENT DOCUMENTS

JP 2008-162035 A 7/2008
JP 2012-111123 A 4/2011

* cited by examiner

*Primary Examiner* — Jannelle M Lebron
(74) *Attorney, Agent, or Firm* — SOLARIS Intellectual Property Group, PLLC

(57) ABSTRACT

There is provided an image forming apparatus including: at least two guide members; a drying section; an ink curing section that illuminates light onto a front surface of the recording medium that has been dried by the drying section and cures the ink; a single liquid coolant circulation device that circulates liquid coolant to respectively formed circulation flow paths between the liquid coolant circulation device and a plurality of cooling targets for which cooling is required due to heat of the drying section or heat of the ink curing section, that cools one of the cooling targets with intermittent circulation of liquid coolant, and that cools another of the cooling targets with continuous circulation of liquid coolant; and an opening and closing portion that opens and closes one of the circulation flow paths to intermittently circulate the liquid coolant of the one cooling target.

9 Claims, 11 Drawing Sheets

IMAGE FORMING APPARATUS

CROSS-REFERENCE TO RELATED APPLICATION

This application is based on and claims priority under 35 USC 119 from Japanese Patent Application No. 2012-198701 filed on Sep. 10, 2012, the disclosure of which is incorporated by reference herein.

BACKGROUND

1. Technical Field

The present invention relates to an image forming apparatus.

2. Related Art

Japanese Patent Application Laid-Open (JP-A) No. 2008-162035 discloses an inkjet printer provided with a drying device that dries an ink image on paper. The inkjet printer includes a conveyor belt that conveys the paper formed with the ink image at a portion facing the drying device. The conveyor belt that has been heated by the drying device is then cooled by a cooling device.

JP-A No. 2012-111123 discloses an inkjet printing apparatus wherein water-based ink is dried by heat and also dried by ultraviolet radiation. In the printing apparatus, a printed web is cooled by a cooling device after the web has been fed to an ink drying device and the ink has been dried.

In JP-A No. 2008-162035, the cooling device only performs cooling of the conveyor belt. In JP-A No. 2012-111123, the printed web is cooled by the cooling device. Namely, according to both Patent Documents, the respective cooling devices only have 1 cooling target, rather than plural cooling targets that are cooled by a single cooling device.

SUMMARY

In consideration of the above circumstances, the present invention provides an image forming apparatus capable of cooling plural cooling targets with a single liquid coolant circulation device.

An image forming apparatus of a first aspect of the present invention includes: at least two guide members that guide a conveyed recording medium; a drying section that is disposed facing one of the guide members and that dries ink that has been jetted onto the recording medium; an ink curing section that is disposed facing another of the guide members and that illuminates light onto a front surface of the recording medium that has been dried by the drying section and cures the ink; a single liquid coolant circulation device that circulates liquid coolant to respectively formed circulation flow paths between the liquid coolant circulation device and plural cooling targets for which cooling is required due to heat of the drying section or heat of the ink curing section, that cools one of the cooling targets with intermittent circulation of liquid coolant, and that cools another of the cooling targets with continuous circulation of liquid coolant; and an opening and closing portion that opens and closes one of the circulation flow paths to intermittently circulate the liquid coolant of the one cooling target.

According to the invention as described above, the conveyed recording medium is guided by the at least two guide members, and the ink that has been jetted onto the recording medium is dried by the drying section disposed facing the one guide member. The ink curing section disposed facing the other of the guide members ink cures the ink by illuminating light onto the front surface of the recording medium that has been dried. In the image forming apparatus, the single liquid coolant circulation device circulates the liquid coolant to the respectively formed circulation flow paths between the liquid coolant circulation device and the plural cooling targets for which cooling is required due to the heat of the drying section or the heat of the ink curing section. The liquid coolant of the one cooling target is intermittently circulated here by opening and closing the opening and closing portion of the one cooling flow path. Accordingly, the one cooling target is cooled with intermittent circulation of liquid coolant, and the other cooling target is cooled with continuous circulation of liquid coolant. Plural cooling targets can accordingly be cooled with a single liquid coolant circulation device.

A second aspect of the present invention is the image forming apparatus of the first aspect, further including: a bypass flow path connecting together an inflow flow path and a return flow path configuring the one circulation flow path; and the opening and closing portion is configured so as to switch the liquid coolant between a route in which the liquid coolant circulates through the one cooling target, and a route in which the liquid coolant circulates through the bypass flow path.

According to the invention as described above, the plural cooling targets are cooled with a substantially uniform liquid coolant flow rate by the liquid coolant circulation device circulating the liquid coolant through the circulation flow path.

When intermittently circulating the liquid coolant to regulate the temperature of the one cooling target, namely when not circulating liquid coolant to the one cooling target with cooling thereof stopped, the opening and closing portion is operated such that the liquid coolant returns to the liquid coolant circulation device through the inflow flow path, the bypass flow path and the return flow path without flowing to the cooling target. Fluctuations in the overall circulation flow rate are accordingly suppressed, and fluctuations do not occur in the cooling performance of the cooling target that is being cooled by continuous circulation.

A third aspect of the present invention is the image forming apparatus of the second aspect, wherein the opening and closing portion includes a first opening and closing valve provided to the inflow flow path further to the cooling target side than a connection portion between the inflow flow path and the bypass flow path, and a second opening and closing valve provided to the bypass flow path.

According to the invention as described above, by opening the first opening and closing valve and closing the second opening and closing valve, on leaving the liquid coolant circulation device, the liquid coolant returns to the liquid coolant circulation device through the inflow flow path, the cooling target, and the return flow path. The cooling target is accordingly continuously cooled by the liquid coolant.

By closing the first opening and closing valve and opening the second opening and closing valve, on leaving the liquid coolant circulation device, the liquid coolant returns to the liquid coolant circulation device through the inflow flow path, the bypass flow path, and the return flow path. Cooling is stopped since the liquid coolant does not flow into the cooling target, however since the flow rate of liquid coolant circulated by the liquid coolant circulation device does not fluctuate, there is no effect on the cooling performance of the other cooling target(s).

A fourth aspect of the present invention is the image forming apparatus of the third aspect, wherein: when stopping cooling of the one cooling target, the second opening and closing valve is opened at the same time as or before the first opening and closing valve is closed; and when starting cooling of the one cooling target, the second opening and closing valve is closed at the same time as or after the first opening and closing valve is opened.

According to the invention as described above, the second opening and closing valve is opened at the same time as or before the first opening and closing valve is closed, and the second opening and closing valve is closed at the same time as or after the first opening and closing valve is opened. A state in which the first opening and closing valve and the second opening and closing valve are closed at the same time is accordingly avoided. Liquid coolant can accordingly be suppressed from building up and imparting load in the flow paths respectively provided with the first opening and closing valve and the second opening and closing valve.

A fifth aspect of the present invention is the image forming apparatus of any of the first aspect to the fourth aspect, wherein: the one cooling target is one of the guide members; and the other cooling target is another of the guide members or the ink curing section, or the other cooling target is another of the guide members and the ink curing section.

According to the invention as described above, the guide member that is the one cooling target is cooled by intermittent circulation, and the other of the guide members or the ink curing section that is the other cooling target, or the other of the guide members and the ink curing section that are the other cooling targets, is/are cooled by continuous circulation. The plural cooling targets that require cooling due to the heat of the drying section or the heat of the ink curing section can accordingly be cooled more appropriately by intermittent circulation or continuous circulation.

A sixth aspect of the present invention is the image forming apparatus of the fifth aspect, wherein: the guide member provided facing the drying section is cooled by the intermittent circulation; and the guide member provided facing the ink curing section is cooled by the continuous circulation.

According to the invention as described above, the guide member provided facing the drying section is cooled by intermittent circulation of the liquid coolant, and the guide member provided facing the ink curing section is cooled by continuous circulation of the liquid coolant. The respective guide members can accordingly be cooled using different cooling methods.

A seventh aspect of the present invention is the image forming apparatus of any of the first aspect to the fourth aspect, further including: a temperature detection sensor that detects the temperature of one of the guide members; and the temperature of the guide member is controlled by the intermittent circulation based on a detection temperature of the temperature detection sensor.

According to the invention as described above, the temperature of the one guide member is detected by the temperature detection sensor, and the guide member is cooled by intermittent circulation of the liquid coolant based on the detection temperature of the temperature detection sensor. The temperature of the guide member can accordingly be appropriately regulated.

An eighth aspect of the present invention is the image forming apparatus of the seventh aspect, wherein control is made such that: the first opening and closing valve is opened and the second opening and closing valve is closed when the temperature of the guide member has reached an upper limit setting temperature or above; and the first opening and closing valve is closed and the second opening and closing valve is opened when the temperature of the guide member has reached a lower limit setting temperature.

According to the invention as described above, the first opening and closing valve of the intermittent circulation flow path is opened and the second opening and closing valve of the bypass flow path is closed when the temperature of the guide member has reached the upper limit setting temperature or above, and the first opening and closing valve is closed and the second opening and closing valve is opened when the temperature of the guide member has reached the lower limit setting temperature. The guide member can accordingly be maintained within a specific temperature range.

A ninth aspect of the present invention is the image forming apparatus of any of the first aspect to the fourth aspect, further including: a chain gripper that grips a leading edge of the recording medium and that conveys the recording medium along the guide members; and a suction adhesion portion that suction adheres the recording medium to the guide member.

According to the invention as described above, the recording medium is conveyed along the guide members in a state in which the leading edge of the recording medium is gripped by the chain gripper and the recording medium is suction adhered to the guide member by the suction adhesion portion. Plural cooling targets here including the guide members on which the recording medium are conveyed can be cooled by the single liquid coolant circulation device.

Due to configuring the present invention as described above, plural cooling targets can be cooled by the single liquid coolant circulation device.

BRIEF DESCRIPTION OF THE DRAWINGS

Exemplary embodiments of the present invention will be described in detail based on the following figures, wherein.

DETAILED DESCRIPTION

Explanation follows regarding an exemplary embodiment of the present invention, with reference to the drawings.

Apparatus Configuration

Figure 1:
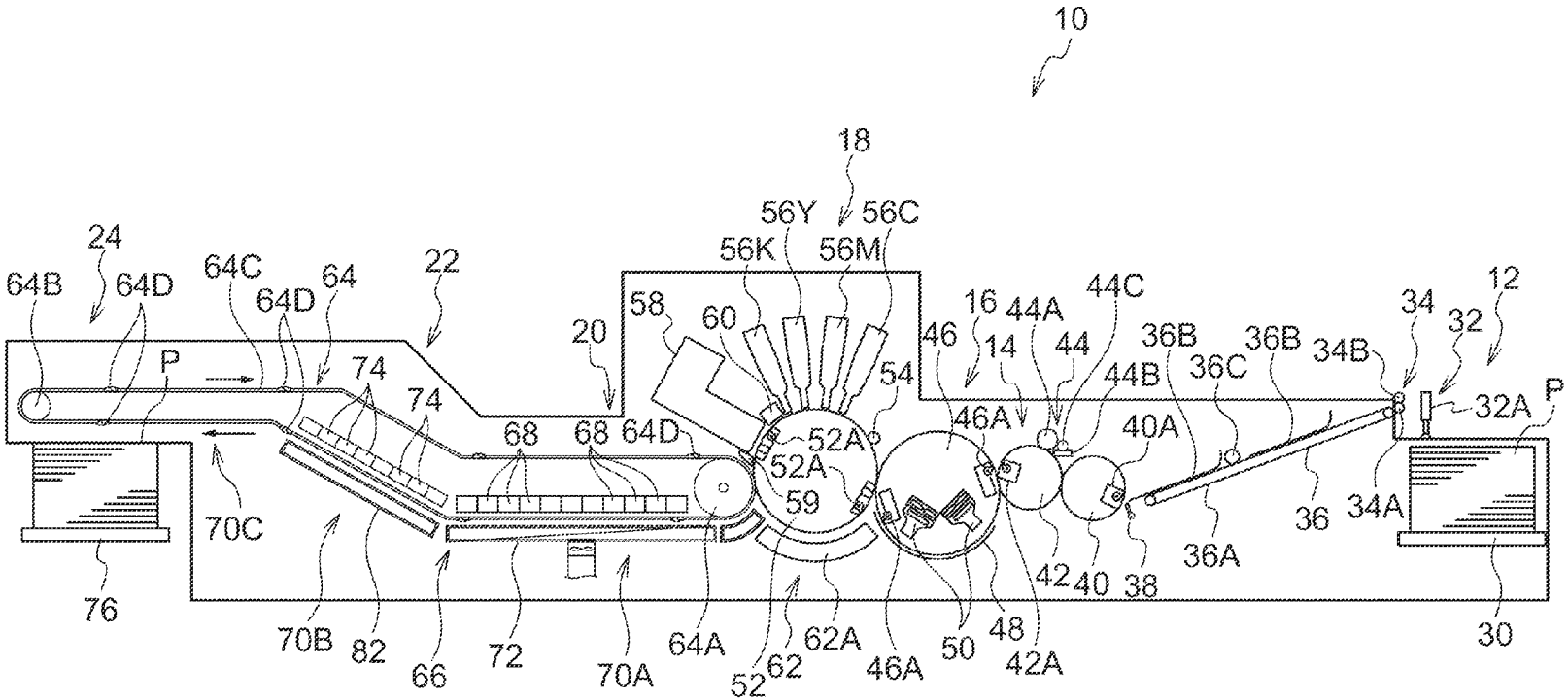
FIG. 1 is a side view illustrating an image forming apparatus according to a first exemplary embodiment of the present invention.

FIG. 1 is a drawing of an overall configuration of an exemplary embodiment of an inkjet recording apparatus serving as an image forming apparatus of the present invention.

An inkjet recording apparatus 10 is an inkjet recording apparatus for recording an image on sheets of paper P (recording medium) by an inkjet method using water-based UV inks (inks that use an aqueous medium and are cured with ultraviolet (UV) light). The inkjet recording apparatus 10 is configured so as to principally include: a paper feed section 12 for feeding the paper P; a process liquid application section 14 for applying a specific process liquid onto the front surface (image recording surface) of the paper P fed in from the paper feed section 12; a process liquid drying section 16 for drying the paper P applied with the process liquid by the process liquid application section 14; an image recording section 18 for recording an image with an inkjet method using water-based UV inks on the front surface of the paper P that has been subjected to drying by the process liquid drying section 16; an ink drying section 20 for drying the paper P recorded with an image by the image recording section 18; a UV irradiation section 22 for performing UV irradiation (fixing processing) to the paper P dried by the ink drying section 20 so as to fix images onto the paper P; and a paper discharge section 24 for discharging the paper P that has been irradiated with UV by the UV irradiation section 22.

Paper Feed Section

The paper feed section 12 feeds paper P stacked on a paper feed plate 30 to the process liquid application section 14 one sheet at a time. The paper feed section 12, serving as an example of a paper feed section, is configured so as to principally include: the paper feed plate 30; a sucker device 32; a pair of paper feed rollers 34; a feeder board 36; a front stop 38; and a paper feed drum 40.

The paper P is placed on the paper feed plate 30 in a bundle of multiple stacked sheets. The paper feed plate 30 is equipped with a paper feed plate raising and lowering device, not illustrated in the drawings, that is capable of raising and lowering the paper feed plate 30. The paper feed plate raising and lowering device is coordinated with increases and decreases in the paper P stacked on the paper feed plate 30, with drive of the paper feed plate raising and lowering device controlled to raise and lower the paper feed plate 30 such that the paper P positioned uppermost in the batch is at a constant height.

The paper P serving as a recording medium is not particularly limited, and general purpose printing paper (paper principally formed from cellulose, such as is referred to as premium grade paper, coated paper, or art paper) used in offset printing may be employed. In the present example, coating treated paper is employed. Coating treated paper is for example a paper coated with a coating material to provide a coating layer on a surface that is generally not surface treated, such as a surface of a premium grade paper or acid-free paper. Specifically, art paper, coated paper, lightly coated paper and finely coated paper are preferably employed.

The sucker device 32 picks up the paper P stacked on the paper feed plate 30 one sheet at a time in sequence from the top, and feeds the paper P to the pair of paper feed rollers 34. The sucker device 32 is equipped with suction feet 32A provided so as to be capable of raising, lowering and swinging. The top surface of the paper P is suction-attached and retained by the suction feet 32A, such that the paper P is conveyed from the paper feed plate 30 to the pair of paper feed rollers 34. Specifically the suction feet 32A suction-attach and retain the top face of the leading edge side of the uppermost paper P, pick up the paper P, and insert the leading edge of the picked-up paper P between a pair of rollers 34A, 34B that configure the pair of paper feed rollers 34.

The pair of paper feed rollers 34 are configured by a pair of top and bottom rollers 34A, 34B that are in press contact with each other. One out of the pair of top and bottom rollers 34A, 34B is a drive roller (roller 34A) and the other is a following roller (roller 34B). The drive roller (roller 34A) is rotationally driven by a motor, not illustrated in the drawings. The motor is driven in coordination with feeding the paper P. When the paper P is fed from the sucker device 32, the motor rotates the drive roller (roller 34A) at a coordinated timing. The paper P inserted between the pair of top and bottom rollers 34A, 34B is nipped by the rollers 34A, 34B and fed in the rotation direction of the rollers 34A, 34B (the direction in which the feeder board 36 is disposed).

The feeder board 36 is formed corresponding to the paper width, and receives the paper P fed out by the pair of paper feed rollers 34 and guides the paper P to the front stops 38. The feeder board 36 is disposed so as to slope downwards, and the paper P placed on the conveyance face of the feeder board 36 is then guided by sliding along the conveyance face to the front stops 38.

Plural tape feeders 36A for conveying the paper P are disposed to the feeder board 36 at intervals in the width direction. The tape feeders 36A are formed in an endless shape, and are driven so as to rotate by a motor, not illustrated in the drawings. The paper P placed on the conveyance face of the feeder board 36 is fed by the tape feeders 36A and conveyed on the feeder board 36.

Retainers 36B and a roller 36C are also disposed on the feeder board 36. Plural of the retainers 36B are disposed front-to-rear in lines along the paper P conveyance face (two in the present example). The retainers 36B are configured by plate springs with a width corresponding to the paper width, and are disposed in press contact with the conveyance face. Unevenness in the paper P conveyed on the feeder board 36 by the tape feeders 36A is corrected by passing under the retainers 36B. Note that the retainers 36B are formed with curled rear end portions in order to make it easier to introduce the paper P in between the retainers 36B and the feeder board 36.

The roller 36C is provided between the front and rear retainers 36B. The roller 36C is disposed in press contact with the conveyance surface of the paper P. The paper P being conveyed between the front and rear retainers 36B is conveyed with the top surface of the paper P pressed down by the roller 36C.

The front stop 38 corrects the orientation of the paper P. The front stop 38 is formed in a plate shape and is disposed orthogonally to the paper P conveyance direction. The front stop 38 is driven by a motor, not illustrated in the drawings, and is provided so as to be capable of swinging. The orientation of the paper P being conveyed on the feeder board 36 is corrected by the leading edge of the paper P contacting the front stop 38 (called skew prevention). The front stop 38 swings in coordination with paper feed to the paper feed drum 40, and the orientation-corrected paper P is passed over to the paper feed drum 40.

The paper feed drum 40 receives the paper P fed from the feeder board 36 through the front stops 38 and conveys the paper P towards the process liquid application section 14. The paper feed drum 40 is formed in a circular cylindrical shape and is rotationally driven by a motor, not illustrated in the drawings. Grippers 40A are also provided on the outer peripheral surface of the paper feed drum 40 for gripping the leading edge of the paper P. The paper feed drum 40 thereby conveys the paper P towards the process liquid application section 14 by rotating with the leading edge portions of the paper P gripped by the grippers 40A and the paper P wrapped onto the peripheral surface of the paper feed drum 40.

The paper feed section 12 is configured as described above. The paper P stacked on the paper feed plate 30 is picked up one sheet at a time by the sucker device 32 in sequence from the top sheet and fed into the pair of paper feed rollers 34. The paper P that has been fed into the pair of paper feed rollers 34 is conveyed out forwards by the pair of top and bottom rollers 34A, 34B configuring the pair of paper feed rollers 34, and placed on the feeder board 36. The paper P that has been placed on the feeder board 36 is conveyed by the tape feeders 36A provided to the conveyance face of the feeder board 36. During the conveyance process, the retainers 36B press against the conveyance face of the feeder board 36, correcting any unevenness. The leading edge of the paper P conveyed by the feeder board 36 contacts the front stop 38 and skew is corrected, after which the paper P is passed across to the paper feed drum 40. The paper P is then conveyed to the process liquid application section 14 by the paper feed drum 40.

Process Liquid Application Section

The process liquid application section 14 applies a specific process liquid to the front surface (image recording face) of the paper P. The process liquid application section 14 is configured so as to principally include: a process liquid application drum 42 for conveying the paper P, and a process liquid application unit 44 for applying a specific process liquid to the printing surface of the paper P being conveyed by the process liquid application drum 42.

The process liquid application drum 42 receives the paper P from the paper feed drum 40 of the paper feed section 12 and conveys the paper P towards the process liquid drying section 16. The process liquid application drum 42 is formed in a circular cylindrical shape and is rotationally driven by a motor, not illustrated in the drawings. Grippers 42A are also provided on the outer peripheral surface of the process liquid application drum 42 for gripping the leading edge of the paper P. The process liquid application drum 42 conveys the paper P towards the process liquid drying section 16 by rotating with the leading edge of the paper P gripped by the grippers 42A and with the paper P wrapped around the peripheral surface of the process liquid application drum 42 (one sheet of the paper P is conveyed with one rotation of the process liquid application drum 42). The rotation of the process liquid application drum 42 and the paper feed drum 40 are controlled such that timings for passing over and receiving the paper P are coordinated with each other. Namely, the process liquid application drum 42 and the paper feed drum 40 are driven such that they have the same peripheral speed and are driven such that the positions of the grippers are coordinated with each other.

The process liquid application unit 44 uses a roller to coat the process liquid on the front surface of the paper P being conveyed by the process liquid application drum 42. The process liquid application unit 44 is configured so as to principally include: a coating roller 44A for coating process liquid to the paper P; a process liquid tank 44B in which process liquid is stored; and a pickup roller 44C for picking up process liquid stored in the process liquid tank 44B and feeding it to the coating roller 44A. The pickup roller 44C is disposed in press contact with the coating roller 44A, and a portion of the pickup roller 44C is disposed submerged in the process liquid stored in the process liquid tank 44B. The pickup roller 44C picks up and meters the process liquid and applies the process liquid to the peripheral surface of the coating roller 44A with a uniform thickness. The coating roller 44A is provided corresponding to the paper width, and makes press contact with the paper P, coating the paper P with the process liquid that has been applied to the peripheral surface of the coating roller 44A. The coating roller 44A is driven by a contact/separation mechanism, not illustrated in the drawings, and moves between a contact position contacting the peripheral surface of the process liquid application drum 42 and a separation position away from the peripheral surface of the process liquid application drum 42. The contact/separation mechanism moves the coating roller 44A coordinated with a timing at which the paper P passes through, coating the process liquid onto the front surface of the paper P that is being conveyed by the process liquid application drum 42.

Note than in the present example, configuration is made wherein the process liquid is coated by a roller, however the method for applying the process liquid is not limited thereto. Configuration may also be adopted wherein the process liquid is applied employing inkjet heads, or applied as a spray.

The process liquid application section 14 is configured as described above. The paper P passed over from the paper feed drum 40 of the paper feed section 12 is received by the process liquid application drum 42. The process liquid application drum 42 grips the leading edge of the paper P with the grippers 42A and rotates to convey the paper P wrapped around the peripheral surface of the process liquid application drum 42. During this conveyance process, the coating roller 44A makes press contact with the front surface of the paper P, coating the process liquid onto the front surface of the paper P.

Note that the process liquid coated onto the front surface of the paper P has a function of aggregating coloring matter in the water-based UV inks that are dotted onto the paper P in the image recording section 18 at a later stage. Due to coating such a process liquid on the front surface of the paper P and dotting on water-based UV inks, pattern interference and the like can be avoided, enabling high quality printing to be performed even when general printing paper is used.

Process Liquid Drying Section

The process liquid drying section 16 dries the paper P whose front surface has been applied with process liquid. The process liquid drying section 16 is configured so as to principally include: a process liquid drying drum 46 for conveying the paper P; a paper conveyance guide 48; and process liquid drying units 50 for drying the process liquid by blowing hot air onto the printing surface of the paper P being conveyed by the process liquid drying drum 46.

The process liquid drying drum 46 receives the paper P from the process liquid application drum 42 of the process liquid application section 14 and conveys the paper P towards the image recording section 18. The process liquid drying drum 46 is configured with a circular cylindrical shaped frame body and is rotationally driven by a motor, not illustrated in the drawings. Grippers 46A are provided on the outer peripheral surface of the process liquid drying drum 46 for gripping the leading edge of the paper P. The process liquid drying drum 46 conveys the paper P towards the image recording section 18 by rotating with the leading edge of the paper P gripped by the grippers 46A. Note that the process liquid drying drum 46 of the present example is provided with the grippers 46A at two locations on the outer peripheral surface, in a configuration capable of conveying two sheets of the paper P with a single rotation. Rotation of the process liquid drying drum 46 and the process liquid application drum 42 is controlled such that the timings for receiving and passing over the paper P are coordinated with each other. Namely, the process liquid drying drum 46 and the process liquid application drum 42 are driven such that they have the same peripheral speed and are driven such that the positions of the grippers are coordinated with each other.

The paper conveyance guide 48 is disposed along the paper P conveyance path to the side of the process liquid drying drum 46, and guides conveyance of the paper P.

The process liquid drying units 50 are disposed inside the process liquid drying drum 46, and dry by blowing hot air onto the front surface of the paper P being conveyed by the process liquid drying drum 46. In the present example, two of the process liquid drying units 50 are provided inside the process liquid drying drum 46, and are configured to blow hot air towards the front surface of the paper P that is being conveyed by the process liquid drying drum 46.

The process liquid drying section 16 is configured as described above. The paper P passed over from the process liquid application drum 42 of the process liquid application section 14 is received by the process liquid drying drum 46. The process liquid drying drum 46 grips the leading edge of the paper P with the grippers 46A, and rotates to convey the paper P. The process liquid drying drum 46 here conveys the paper P with the front surface (the surface coated with the process liquid) facing towards the inside. The paper P is dried by blowing hot air from the process liquid drying units 50 disposed inside the process liquid drying drum 46 onto the front surface of the paper P whilst the paper P is being conveyed by the process liquid drying drum 46. Namely the solvent component in the process liquid is driven off. An ink aggregation layer is accordingly formed on the front surface of the paper P.

Image Recording Section

The image recording section 18 renders a color image on the printing surface of the paper P by dotting liquid droplets of ink (water-based UV ink) of colors C, M, Y, K onto the printing surface of the paper P. The image recording section 18 is configured so as to principally include: an image recording drum 52 for conveying the paper P; a paper press roller 54 for pressing the paper P conveyed by the image recording drum 52 so as to place the paper P in close contact with the peripheral surface of the image recording drum 52; inkjet heads 56C, 56M, 56Y, 56K serving as examples of jetting heads for jetting ink droplets of each color C, M, Y, K onto the paper P; an inline sensor 58 for reading an image recorded on the paper P; a mist filter 60 for trapping ink mist; and a drum cooling unit 62.

The image recording drum 52 receives the paper P from the process liquid drying drum 46 of the process liquid drying section 16 and conveys the paper P towards the ink drying section 20. The image recording drum 52 is formed in a circular cylindrical shape and is rotationally driven by a motor, not illustrated in the drawings. Grippers 52A are provided on the outer peripheral surface of the image recording drum 52 for gripping leading edges of the paper P. The image recording drum 52 conveys the paper P towards the ink drying section 20 by rotating with the leading edges of the paper P gripped by the grippers 52A and the paper P wrapped around the peripheral surface of the image recording drum 52. The peripheral surface of the image recording drum 52 is further provided with multiple suction holes (not illustrated in the drawings), formed in a specific pattern. The paper P wrapped around the peripheral surface of the image recording drum 52 is conveyed whilst being suction-retained on the peripheral surface of the image recording drum 52 by the suction of the suction holes. The paper P can accordingly be conveyed with a high degree of flatness.

Note that the suction of the suction holes only acts over a certain range, acting between a specific suction start position to a specific suction end position. The suction start position is set as the disposal position of the paper press roller 54, and the suction end position is set at the downstream side of the disposal position of the inline sensor 58 (for example, set at the position where paper is passed to the ink drying section 20). Namely, setting is made such that the paper P is suction-retained to the peripheral surface of the image recording drum 52 at least at the disposal positions of the inkjet heads 56C, 56M, 56Y, 56K (image recording positions) and the disposal position of the inline sensor 58 (image reading position).

The mechanism for suction retention of the paper P to the peripheral surface of the image recording drum 52 is not limited to the above negative pressure suction attachment method, and a method employing electrostatic attraction may also be adopted.

The image recording drum 52 of the present exemplary embodiment is disposed with the grippers 52A at two locations on the outer peripheral surface, in a configuration capable of conveying two sheets of the paper P with a single rotation. Rotation of the image recording drum 52 and the process liquid drying drum 46 is controlled such that the timings for receiving and passing over the paper P are coordinated with each other. Namely, the image recording drum 52 and the process liquid drying drum 46 are driven such that they have the same peripheral speed, and are driven such that the positions of the grippers are coordinated with each other.

The paper press roller 54 is disposed in the vicinity of the sheet member receiving position of the image recording drum 52 (the position where the paper P is received from the process liquid drying drum 46). The paper press roller 54 is configured from a rubber roller, and is disposed so as to be in press contact with the peripheral surface of the image recording drum 52. The paper P that has been passed over to the image recording drum 52 from the process liquid drying drum 46 accordingly makes close contact with the peripheral surface of the image recording drum 52 due to being nipped on passing the paper press roller 54.

The four inkjet heads 56C, 56M, 56Y, 56K are disposed at uniform intervals along the conveyance path of the paper P to the side of the image recording drum 52. The inkjet heads 56C, 56M, 56Y, 56K are configured as line heads corresponding to the paper width, with a nozzle face disposed facing the peripheral surface of the image recording drum 52. Each of the inkjet heads 56C, 56M, 56Y, 56K record an image on the paper P being conveyed by the image recording drum 52 by jetting liquid ink droplets towards the image recording drum 52 from nozzle rows formed on the nozzle face.

Water-based UV ink is employed for the ink jetted from each of the inkjet heads 56C, 56M, 56Y, 56K. The water-based UV inks can be cured by irradiation with ultraviolet radiation (UV) after droplet impact.

The inline sensor 58 is disposed at the side of the image recording drum 52 on the downstream side of the last of the inkjet heads 56K in the conveyance direction of the paper P. The inline sensor 58 reads the image recorded on the paper P by the inkjet heads 56C, 56M, 56Y, 56K. The inline sensor 58 is for example configured by a line scanner, and reads the image recorded by the inkjet heads 56C, 56M, 56Y, 56K on the paper P being conveyed by the image recording drum 52.

A contact prevention plate 59 is disposed at the conveyance direction downstream side of the inline sensor 58 and adjacent to the inline sensor 58. The contact prevention plate 59 prevents the paper P from making contact with the inline sensor 58 when lifting of the paper P occurs due for example to poor conveyance.

The mist filter 60 is disposed between the last of the inkjet heads 56K and the inline sensor 58 so as to suck in air at the periphery of the image recording drum 52 and capture any ink mist. Ink mist is thereby suppressed from penetrating to the inline sensor 58 due to air being sucked in at the periphery of the image recording drum 52 and ink mist being captured, suppressing the occurrence of for example read errors.

The drum cooling unit 62 blows cool air onto the image recording drum 52, cooling the image recording drum 52. The drum cooling unit 62 is configured to principally include an air conditioner, not illustrated in the drawings, and a duct 62A to blow cooled air supplied from the air conditioner onto the peripheral surface of the image recording drum 52. The duct 62A blows cooled air towards the image recording drum 52 at a region outside a paper P conveyance region, and cools the image recording drum 52. In the present example, the duct 62A is configured to blow cooled air and cool the image recording drum 52 at a region that is substantially the bottom side half of the image recording drum 52, since the paper P is conveyed substantially at the top side half of the circular arc shaped face of the image recording drum 52. More specifically, the outlet of the duct 62A is formed in a circular arc shape so as to cover substantially the lower side half of the image recording drum 52 and is configured to blow cooled air at a region that is substantially the lower side half of the image recording drum 52.

The temperature to which the image recording drum 52 is cooled is set based on a relationship with the temperature of the inkjet heads 56C, 56M, 56Y, 56K (in particular, the temperature of the nozzle face), such that the image recording drum 52 is cooled to a lower temperature than the temperature of the inkjet heads 56C, 56M, 56Y, 56K. Condensation can accordingly be prevented from occurring on the inkjet heads 56C, 56M, 56Y, 56K. Namely, by lowering the temperature of the image recording drum 52 to below that of the inkjet heads 56C, 56M, 56Y, 56K, any condensation can be induced to occur on the image recording drum side, and condensation can be prevented from occurring on the inkjet heads 56C, 56M, 56Y, 56K (in particular, condensation occurring on the nozzle face).

The image recording section 18 is configured as described above. The paper P passed over from the process liquid drying drum 46 of the process liquid drying section 16 is received by the image recording drum 52. The image recording drum 52 grips the leading edge of the paper P with the grippers 52A and rotates to convey the paper P. First of all, the paper P that has been passed over to the image recording drum 52 passes the paper press roller 54, placing the paper P in close contact with the peripheral surface of the image recording drum 52. At the same time, suction is applied through the suction holes of the image recording drum 52, such that the paper P is suction-retained on the outer peripheral surface of the image recording drum 52. The paper P is conveyed in this state, passing each of the inkjet heads 56C, 56M, 56Y, 56K. Liquid droplets of each color C, M, Y, K of ink are dotted onto the front surface of the paper P from the respective inkjet heads 56C, 56M, 56Y, 56K as the paper P is passing, thereby producing a color image on the front surface. Feathering and bleeding, for example, do not occur since the ink aggregation layer has been formed on the front surface of the paper P, enabling a high quality image to be recorded.

The paper P on which the inkjet heads 56C, 56M, 56Y, 56K have recorded an image then passes the inline sensor 58. The image recorded on the front surface is read as the paper P passes the inline sensor 58. Such reading of the recorded image is performed as necessary, with the read image being inspected for jetting defects, and the like. Reading is performed here with the paper P in the suction-retained state to the image recording drum 52, enabling reading to be performed with high precision. Abnormalities such as jetting defects and the like can be detected immediately due to performing the reading straight after image recording, enabling a swift response. Unnecessary recording can accordingly be prevented, and wasted paper can be suppressed to a minimum.

After releasing the suction adhesion, the paper P is then passed over to the ink drying section 20.

Ink Drying Section

The ink drying section 20 dries the paper P after image recording, and drives off the liquid component remaining on the recording surface of the paper P. The ink drying section 20 is configured to principally include: a chain gripper 64 for conveying the paper P on which an image has been recorded; a back tension application mechanism (suction adhesion portion) 66 serving as an example of a back tension application section that applies back tension to the paper P being conveyed by the chain gripper 64; and ink drying units 68 serving as an example of drying units for drying the paper P being conveyed by the chain gripper 64.

The chain gripper 64 is a common paper conveyance mechanism employed in the ink drying section 20, the water application section 80, the UV irradiation section 22, and the paper discharge section 24. The chain gripper 64 receives the paper P passed from the image recording section 18 and conveys it as far as the paper discharge section 24.

The chain gripper 64 is configured to principally include: first sprockets 64A disposed in the vicinity of the image recording drum 52; second sprockets 64B provided to the paper discharge section 24; endless chains 64C entrained around the first sprockets 64A and the second sprockets 64B; plural chain guides (not illustrated in the drawings) for guiding travel of the chains 64C; and plural grippers 64D attached to the chain 64C at uniform intervals. The first sprockets 64A, the second sprockets 64B, the chains 64C and the chain guides are respectively configured in pairs, and are disposed on both width direction sides of the paper P. The grippers 64D are disposed spanning between the pair of chains 64.

The first sprockets 64A are disposed in the vicinity of the image recording drum 52 so as to be capable of receiving the paper P passed over from the image recording drum 52 with the grippers 64D. The first sprockets 64A are rotatably supported by shaft bearings, not illustrated in the drawings, and are coupled to a motor, not illustrated in the drawings. The chains 64C entrained around the first sprockets 64A and the second sprockets 64B are run by driving the motor.

The second sprockets 64B are provided at the paper discharge section 24 so as to be capable of collecting the paper P received from the image recording drum 52 at the paper discharge section 24. Namely, the disposal position of the second sprockets 64B configures the terminal of the paper P conveyance path along the chain gripper 64. The second sprockets 64B are provided rotatably supported by shaft bearings, not illustrated in the drawings.

The chains 64C are formed with an endless shape, and are entrained around the first sprockets 64A and the second sprockets 64B.

The chain guides are disposed at specific positions, and guide such that the chains 64C travel along a specific path (=guided such that the paper P is conveyed to travel along a specific conveyance path). In the inkjet recording apparatus 10 of the present example, the second sprockets 64B are provided at a position higher than the first sprockets 64A. The chains 64C accordingly form a traveling path that is inclined en route. More specifically, the traveling path is configured from a first horizontal conveyance path 70A, an inclined conveyance path 70B, and a second horizontal conveyance path 70C.

The first horizontal conveyance path 70A is set at a similar height to the first sprockets 64A, and the chains 64C entrained around the first sprockets 64A are set to travel horizontally. The second horizontal conveyance path 70C is set at a similar height to the second sprockets 64B, and the chains 64C entrained around the second sprockets 64B are set to travel horizontally. The inclined conveyance path 70B is set between the first horizontal conveyance path 70A and the second horizontal conveyance path 70C and is set so as to connect the first horizontal conveyance path 70A and the second horizontal conveyance path 70C.

The chain guides are disposed so as to form the first horizontal conveyance path 70A, the inclined conveyance path 70B, and the second horizontal conveyance path 70C. More specifically, the chain guides are disposed at least at a junction point of the first horizontal conveyance path 70A and the inclined conveyance path 70B, and a junction point of the inclined conveyance path 70B and the second horizontal conveyance path 70C.

Plural of the grippers 64D are attached to the chains 64C at uniform intervals. The attachment intervals of the grippers 64D are set so as to match the intervals between receiving the paper P from the image recording drum 52. Namely, the attachment intervals of the grippers 64D are set so as to match the intervals between receiving the paper P from the image recording drum 52, such that the paper P passed over in sequence from the image recording drum 52 can be received from the image recording drum 52 at a coordinated timing.

The chain gripper 64 is configured as described above. As explained above, the chains 64C travel when the motor (not illustrated in the drawings) connected to the first sprockets 64A is driven. The chains 64C travel at the same speed as the peripheral speed of the image recording drum 52. Timing is coordinated such that the paper P passed over from the image recording drum 52 can be received by each of the grippers 64D.

The back tension application mechanism 66 applies back tension to the paper P being conveyed with the leading edge gripped by the chain gripper 64. The back tension application mechanism 66 principally includes a first guide plate 72 serving as a guide member disposed in the ink drying section 20, and a second guide plate 82 serving as a guide member disposed in the UV irradiation section 22.

Figure 2:
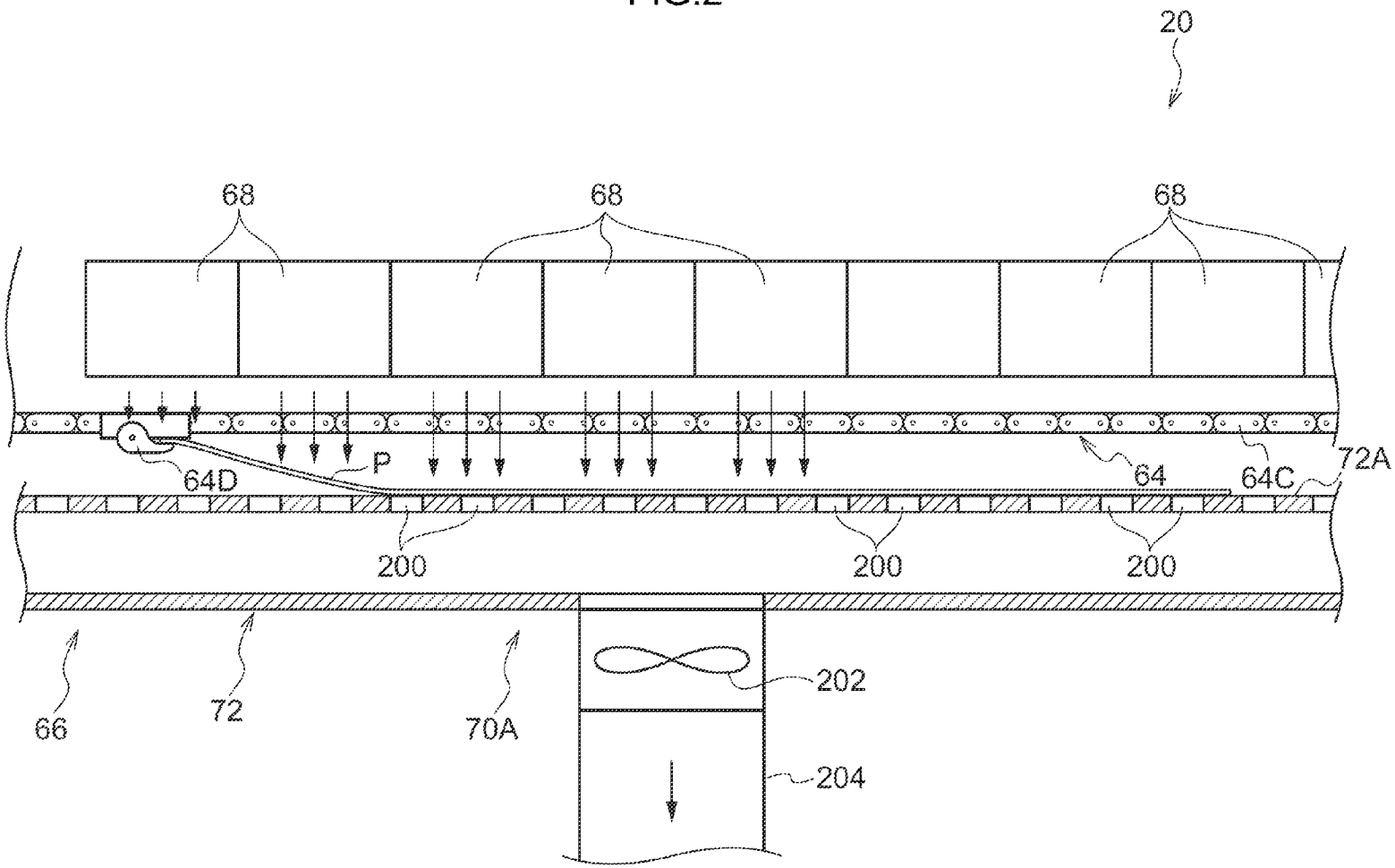
FIG. 2 is a cross-section illustrating an ink drying section, a chain gripper and a first guide member employed in the image forming apparatus illustrated in FIG. 1.

As illustrated in FIG. 2, the first guide plate 72 is configured from a hollow box plate with a width corresponding to the paper width. The first guide plate 72 is provided with multiple suction holes 200 formed to an upper face 72A, and a suction fan 202 that is disposed at a lower portion side of a central portion of the first guide plate 72 and that sucks air through the multiple suction holes 200. The lower portion side of the first guide plate 72 is connected to an air discharge pipe 204 for expelling air that has been sucked through the multiple suction holes 200 by the suction fan 202.

Although not illustrated in the drawings, the second guide plate 82 is similarly configured from a hollow box plate with a width corresponding to the paper width, and is provided with multiple suction holes formed to an upper face, a suction fan that sucks air through the multiple suction holes, and an air discharge pipe for expelling air.

The first guide plate 72 is disposed running along the paper P conveyance path (=the chain running path) by the chain gripper 64. Specifically, the first guide plate 72 is disposed along the chains 64C where they run along the first horizontal conveyance path 70A at a specific separation distance from the chains 64C. The second guide plate 82 is disposed along the chains 64C where they run along the inclined conveyance path 70B at a specific separation distance from the chains 64C. The back face (the face on the side not recorded with the image) of the paper P being conveyed by the chain gripper 64 is conveyed over the upper face of the first guide plate 72 and the upper face of the second guide plate 82 (the faces facing the chains 64C: sliding contact faces) making sliding contact therewith.

Figure 3A:
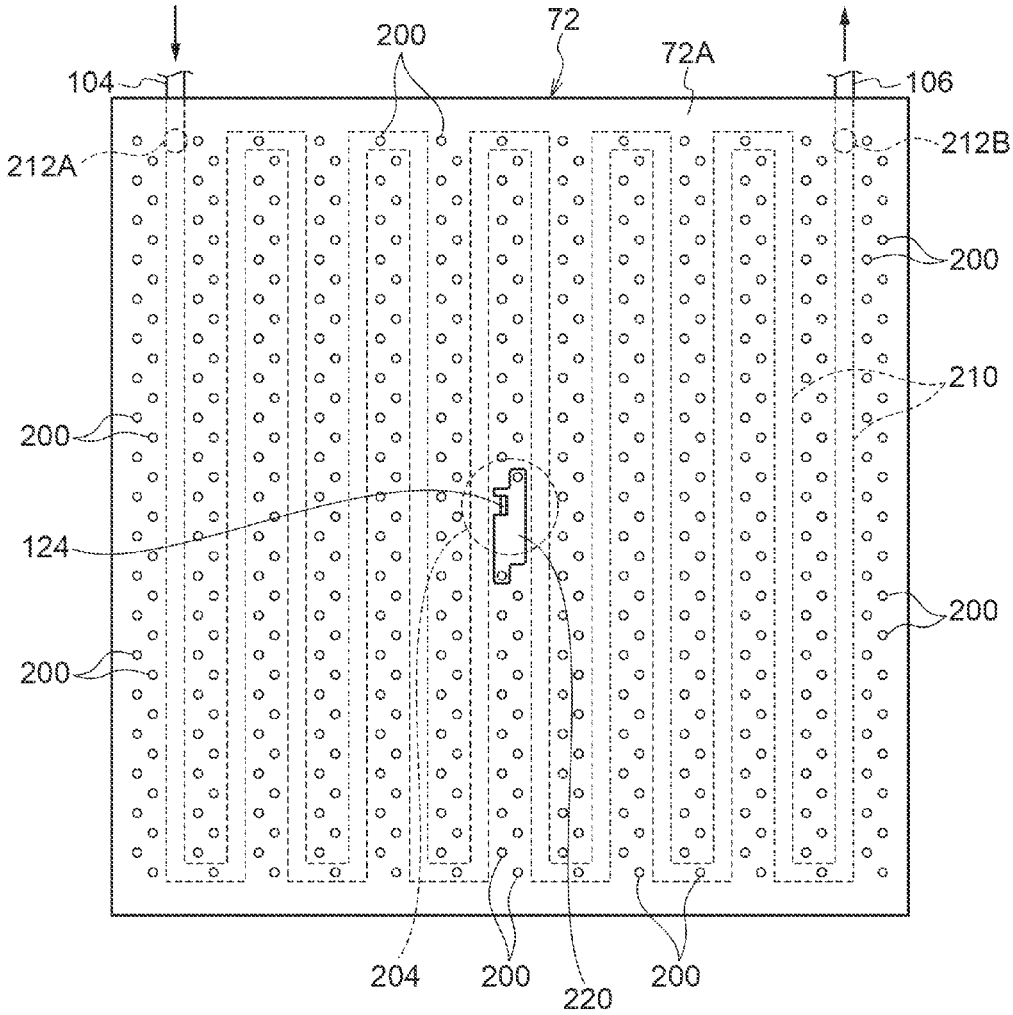
FIG. 3A is a plan view illustrating a first guide member employed in the image forming apparatus illustrated in FIG. 1.

As illustrated in FIG. 2, the sliding contact face (upper face) of the first guide plate 72 is formed with the multiple suction holes 200 in a specific pattern (see FIG. 3A). As described above, the first guide plate 72 is formed by a hollow box plate, with the suction fan 202 creating suction in the hollow portion (inner portion) of the first guide plate 72. Air is accordingly sucked through the suction holes 200 formed in the sliding contact face.

The back surface of the paper P being conveyed by the chain gripper 64 is sucked towards the suction holes 200 due to the air being sucked through the suction holes 200 of the first guide plate 72. Back tension is accordingly applied to the paper P being conveyed by the chain gripper 64. The back surface of the paper P being conveyed by the chain gripper 64 is similarly sucked towards the suction holes in the second guide plate 82, thereby applying back tension to the paper P being conveyed by the chain gripper 64.

As described above, the first guide plate 72 is disposed running along the chains 64C where they run along the first horizontal conveyance path 70A, and the second guide plate 82 is disposed running along the chains 64C where they run along the inclined conveyance path 70B. Back tension is accordingly applied during conveyance between the first horizontal conveyance path 70A and the inclined conveyance path 70B.

As illustrated in FIG. 1, the ink drying units 68 are disposed to the inside of the chain gripper 64 (specifically at the front half side of the location that configures the first horizontal conveyance path 70A), and the ink drying units 68 dry the paper P being conveyed along the first horizontal conveyance path 70A. The ink drying units 68 dry the paper P by blowing hot air onto the recording surface of the paper P being conveyed along the first horizontal conveyance path 70A. Plural of the ink drying units 68 are disposed along the first horizontal conveyance path 70A. The number of the ink drying units 68 provided is set according to such factors as the processing capacity of the ink drying units 68 and the conveyance speed (=printing speed) of the paper P. Namely, setting is made such that the paper P received from the image recording section 18 can be dried whilst being conveyed on the first horizontal conveyance path 70A. The length of the first horizontal conveyance path 70A is accordingly also set in consideration of the capacity of the ink drying units 68

The ink drying section 20 is configured as described above. The paper P passed over from the image recording drum 52 of the image recording section 18 is received by the chain gripper 64. The chain gripper 64 grips the leading edge of the paper P with the grippers 64D and conveys the paper P along the flat plane shaped first guide plate 72. The paper P that has been passed over to the chain gripper 64 is first conveyed over the first horizontal conveyance path 70A. Whilst being conveyed over the first horizontal conveyance path 70A, the paper P is dried by the ink drying units 68 disposed inside the chain gripper 64. Namely, drying is performed by blowing hot air against the front surface (the image recorded face). The paper P is dried here whilst being applied with back tension by the back tension application mechanism 66. Deformation of the paper P can accordingly be suppressed whilst drying.

UV Irradiation Section

The UV irradiation section 22 irradiates ultraviolet radiation (UV) onto images recorded using the water-based UV ink, so as to fix the images. The UV irradiation section 22 is configured so as to principally include the chain gripper 64 to convey the paper P, the back tension application mechanism 66 to apply back tension to the paper P being conveyed by the chain gripper 64, and UV irradiation units 74 serving as examples of a fixing unit that irradiates ultraviolet radiation onto the paper P being conveyed by the chain gripper 64.

As described above, the chain gripper 64 and back tension application mechanism 66 here are also commonly employed over the ink drying section 20, the water application section 80 and the paper discharge section 24.

The UV irradiation units 74 are disposed to the inside of the chain gripper 64 (specifically at a location that configures the inclined conveyance path 70B), and irradiates ultraviolet radiation onto the recording surface of the paper P being conveyed on the inclined conveyance path 70B. The UV irradiation units 74 are provided with an ultraviolet lamp (UV lamp), and plural of the UV irradiation units 74 are disposed along the inclined conveyance path 70B. The UV irradiation units 74 irradiate ultraviolet radiation onto the recording surface of the paper P being conveyed on the inclined conveyance path 70B. The number of the UV irradiation units 74 provided is set according to for example to the conveyance speed of the paper P (=printing speed). Namely, setting is made such that images can be fixed by ultraviolet radiation irradiation whilst the paper P is being conveyed on the inclined conveyance path 70B. The length of the inclined conveyance path 70B is accordingly also set in consideration of for example the conveyance speed of the paper P.

The UV irradiation section 22 is configured as described above. The paper P that is being conveyed by the chain gripper 64 and that has been dried by the ink drying section 20 is then conveyed over the inclined conveyance path 70B. On the inclined conveyance path 70B, the chain gripper 64 conveys the paper P along the second guide plate 82 with the leading edge portion of the paper P gripped by the grippers 64D. During conveyance over the inclined conveyance path 70B, the paper P is UV irradiated by the UV irradiation units 74 disposed inside the chain gripper 64. Namely, ultraviolet radiation is irradiated from the UV irradiation units 74 towards the front surface. UV irradiation of the paper P is performed here whilst back tension is being applied to the paper P by the back tension application mechanism 66. Deformation of the paper P can accordingly be suppressed whilst performing UV irradiation. Since the UV irradiation section 22 is disposed on the inclined conveyance path 70B and the inclined second guide plate 82 is also disposed on the inclined conveyance path 70B, the paper P can be slid over the second guide plate 82 and discharged even if for example the paper P falls out of the grippers 64D during conveyance.

Paper Discharge Section

The paper discharge section 24 collects the paper P that has been subjected to a cycle of image recording processing. The paper discharge section 24 is configured so as to principally include the chain gripper 64 for conveying the UV irradiated paper P, and a paper discharge plate 76 for stacking and collecting the paper P.

As described above, the chain gripper 64 here is also commonly employed over the ink drying section 20 and the UV irradiation section 22. The chain gripper 64 releases the paper P over the paper discharge plate 76, stacking the paper P on the paper discharge plate 76.

The paper discharge plate 76 stacks and collects the paper P released from the chain gripper 64. The paper discharge plate 76 is provided with paper stops (for example a front paper stop, a rear paper stop, and side paper stops) (not illustrated in the drawings) in order to stack the paper P neatly.

The paper discharge plate 76 is equipped with a paper discharge plate raising and lowering device, not illustrated in the drawings, that is capable of raising and lowering the paper discharge plate 76. The paper discharge raising and lowering device is coupled to increases and decreases in the amount of paper stacked in the paper discharge plate 76, with drive controlled so that the paper discharge plate 76 is raised and lowered such that the uppermost sheet of paper P is positioned at a constant height.

Detailed Description of Ink Drying Section and UV Irradiation Section

More detailed explanation follows regarding the ink drying section 20, and the UV irradiation section 22 that are relevant portions of the inkjet recording apparatus 10 of the present exemplary embodiment.

As illustrated in FIG. 2, the paper P conveyed by the chain gripper 64 is dried by the ink drying units 68 in the ink drying section 20. Namely the ink drying section 20 is a mechanism for drying moisture contained in the solvent that has separated out by the aggregation action of the coloring matter. The ink drying section 20 is provided with the ink drying units 68 in which plural sets of for example IR heaters and fans are disposed at positions facing the paper P conveyed by the chain gripper 64.

The chain gripper 64 grips the leading edge of the paper P with the grippers 64D and conveys the paper P along the flat plane shaped first guide plate 72. The paper P is dried by the ink drying units 68 disposed inside the chain gripper 64. The paper P is dried here with hot air from the ink drying units 68 whilst being applied with back tension by the back tension application mechanism 66.

The hot air blower nozzles of the ink drying units 68 are configured so as to blow hot air controlled to a specific temperature towards the paper P at a uniform airflow rate. The respective IR heaters are each controlled to a specific temperature. The hot air blower nozzles and the IR heaters dry the paper P by evaporating moisture contained on the recording face.

Note that evaporated moisture is preferably discharged together with air to outside the apparatus by a discharge section, not illustrated in the drawings. Recycled air may also be cooled by for example a cooling device (radiator) and the evaporated moisture recovered as liquid.

Figure 3B:
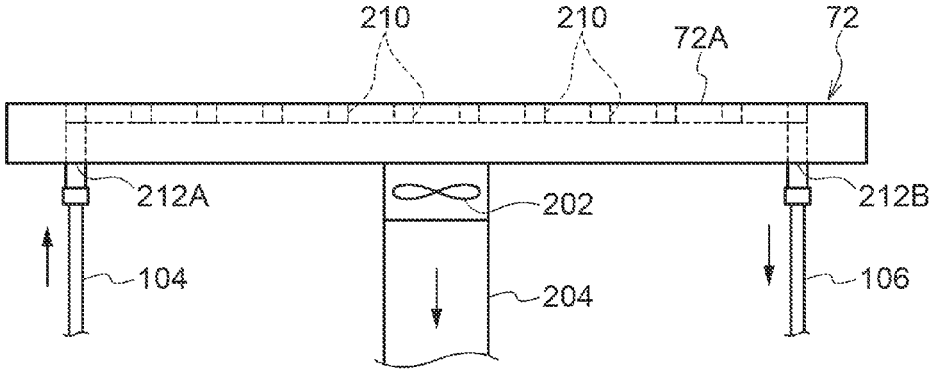
FIG. 3B is a side view of the first guide member illustrated in FIG. 3A.

FIG. 3A is a plan view of the first guide plate 72. FIG. 3B is a side view of the first guide plate 72. As illustrated in FIG. 3A, the upper face 72A (sliding contact face) of the first guide plate 72 is formed with the multiple suction holes 200 in a specific pattern. As illustrated in FIG. 3A and FIG. 3B, the upper face 72A side of the inside of the first guide plate 72 is provided with a cooling flow path 210 in which liquid coolant flows. The cooling flow path 210 is configured by a single elongated flow path disposed so as to snake back and forth between one end portion and the other end portion of the first guide plate 72. In other words, in plan view the cooling flow path 210 is disposed snaking back and forth from one side of the rectangular shaped first guide plate 72 towards another side facing the one side, with each of the snaking flow paths disposed substantially parallel to each other.

One connection port 212A that is a length direction end portion of the cooling flow path 210 is connected to a first flow path 104 serving as an inflow flow path. Liquid coolant is introduced into the cooling flow path 210 from the first flow path 104 through the connection port 212A. The liquid coolant flows through the cooling flow path 210 that is disposed snaking back and forth, thereby cooling at least the upper face 72A side of the first guide plate 72. Another connection port 212B that is an end portion of the cooling flow path 210 on the opposite side to the connection port 212A is connected to a second flow path 206 serving as a return flow path. The liquid coolant is discharged from the cooling flow path 210 into the second flow path 106 through the connection port 212B.

A lid 220 is attached to a central portion of the upper face 72A of the first guide plate 72 illustrated in FIG. 3A. A thermistor (T1) 124 serving as a temperature detection sensor, described later, is attached to the lid 220.

Water (clean water, pure water) or an aqueous solution of ethylene glycol (antifreeze), for example, may be employed as the liquid coolant. Clean water is employed as the liquid coolant in the present exemplary embodiment.

Although not illustrated in the drawings, a coolant flow path of substantially the same configuration as that of the first guide plate 72 is provided snaking back and forth inside the second guide plate 82. Configuration is made such that the upper face side of the second guide plate 82 is cooled by liquid coolant.

Figure 4A:
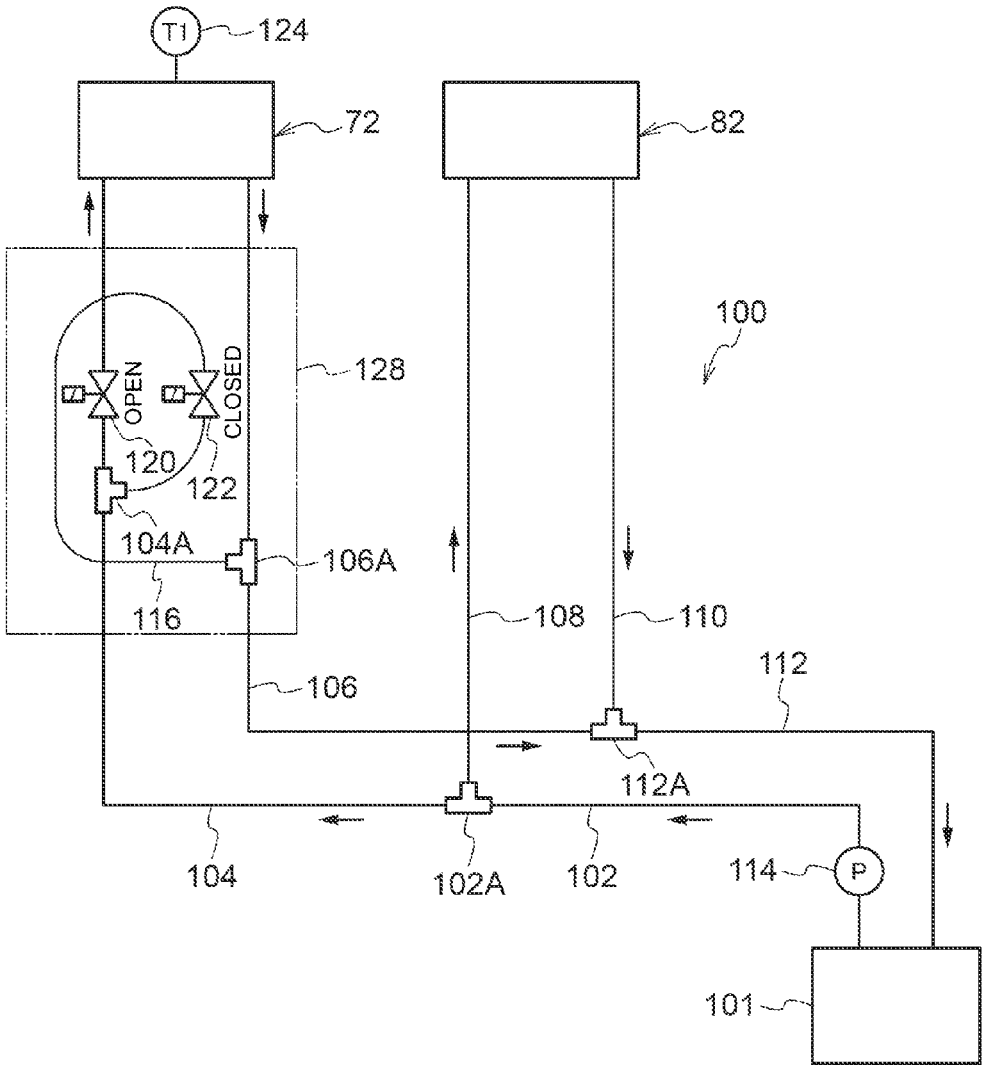
FIG. 4A is a configuration diagram illustrating a liquid coolant circulation device employed in the image forming apparatus illustrated in FIG. 1 in a state in which liquid coolant is being circulated in a cooling flow path of the first guide member.

FIG. 4A illustrates a cooling device 100 that cools the first guide plate 72 and the second guide plate 82 that serve as plural (two in the present exemplary embodiment) cooling targets. As illustrated in FIG. 4A, the cooling device 100 includes a chiller body 101 serving as a single liquid coolant circulation device that circulates the liquid coolant. The cooling device 100 is configured so as to cool the first guide plate 72 that is one cooling target by intermittent circulation of the liquid coolant, and cool the second guide plate 82 that is another cooling target by continuous circulation of the liquid coolant.

More specifically, a single supply side flow path 102 for supplying the liquid coolant is connected to the chiller body 101, with the supply side flow path 102 branching into the first flow path 104 and a third flow path 108, respectively serving as inflow flow paths, at a branch portion 102A. The supply side flow path 102 is provided with a pump 114 for circulating the liquid coolant. The first flow path 104 is connected to the first guide plate 72. Namely the first flow path 104 is connected to the cooling flow path 210 (see FIG. 3A) through the connection port 212A (see FIG. 3A) of the first guide plate 72. The third flow path 108 is connected to the second guide plate 82. Namely, the third flow path 108 is connected to the cooling flow path (not illustrated in the drawings) through a connection port of the second guide plate 82.

The second flow path 106 serving as a return flow path through which the liquid coolant is discharged from the cooling flow path 210 (see FIG. 3A) is connected to the first guide plate 72. A fourth flow path 110 serving as a return flow path through which the liquid coolant is discharged from the cooling flow path (not illustrated in the drawings) is moreover connected to the second guide plate 82. The second flow path 106 and the fourth flow path 110 are merged into a single discharge side flow path 112 at a merging portion 112A. The discharge side flow path 112 is connected to the chiller body 101.

In other words, the first flow path 104 and the second flow path 106 that are connected to the first guide plate 72 and the third flow path 108 and the fourth flow path 110 that are connected to the second guide plate 82 configure circulation flow paths respectively formed between the chiller body 101 and the first guide plate 72 and the second guide plate 82 serving as plural cooling targets.

In the cooling device 100, due to connecting the third flow path 108 and the fourth flow path 110 to the cooling flow path (not illustrated in the drawings) of the second guide plate 82, liquid coolant that has been sent from the chiller body 101 into the supply side flow path 102 is supplied to the third flow path 108 through the branch portion 102A and then supplied to the cooling flow path (not illustrated in the drawings) of the second guide plate 82. The liquid coolant that has been discharged into the fourth flow path 110 from the cooling flow path (not illustrated in the drawings) of the second guide plate 82 merges into the discharge side flow path 112 through the merging portion 112A and is returned to the chiller body 101. The liquid coolant is thereby continuously circulated to the cooling flow path (not illustrated in the drawings) of the second guide plate 82, continuously cooling the second guide plate 82.

A switching device 128 is provided between the first flow path 104 and the second flow path 106 for cooling the first guide plate 72 by intermittent circulation of the liquid coolant. More specifically, a branch portion 104A is provided partway along the first flow path 104, with one end of a bypass flow path 116 connected to the branch portion 104A. A merging portion 106A is provided partway along the second flow path 106. The other end of the bypass flow path 116 is connected to the merging portion 106A. In other words, the bypass flow path 116 is connected between the first flow path 104 and the second flow path 106 that are flow paths for intermittent circulation, with the bypass flow path 116 connected so as to bypass the cooling flow path 210 (see FIG. 3A) of the first guide plate 72 that is the one cooling target.

A first electromagnetic valve 120 serving as a first opening and closing valve is provided to the first flow path 104 on the first guide plate 72 side of the branch portion 104A that branches where the bypass flow path 116 branches off. A second electromagnetic valve 122 serving as a second opening and closing valve is provided to the bypass flow path 116. In other words, the first electromagnetic valve 120 and the second electromagnetic valve 122 configure an opening and closing portion of the present invention, with the second electromagnetic valve 122 being closed and opened coupled with the opening and closing of the first electromagnetic valve 120. Switching can accordingly be made between a route wherein the liquid coolant circulates through the cooling flow path 210 (see FIG. 3A) and a route wherein the liquid coolant circulates through the bypass flow path 116.

The first guide plate 72 is provided with the thermistor (T1) 124 that serves as the temperature detection sensor. In the present exemplary embodiment, the thermistor 124 for example detects the temperature of the upper face 72A (see FIG. 3A) of the first guide plate 72.

Figure 5:
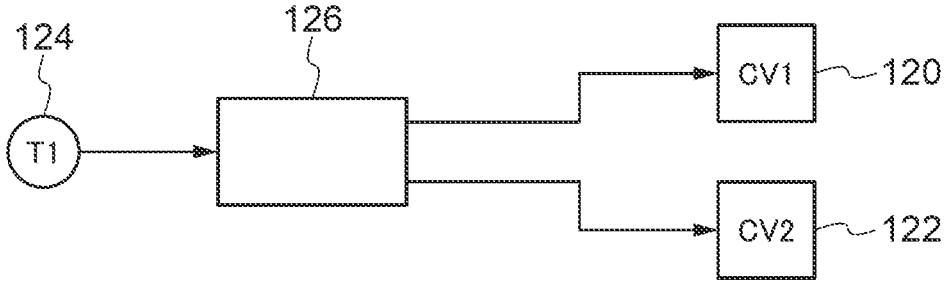
FIG. 5 is a block diagram of a liquid coolant circulation device employed in the image forming apparatus illustrated in FIG. 1.

As illustrated in FIG. 5, a signal for the temperature detected by the thermistor (T1) 124 is input into a controller 126. The controller 126 controls opening and closing of the first electromagnetic valve (CV1) 120 and closing and opening of the second electromagnetic valve (CV2) 122 based on the temperature detected by the thermistor (T1) 124. In other words, the controller 126 performs control such that the second electromagnetic valve (CV2) 122 is closed and opened coupled with the opening and closing of the first electromagnetic valve (CV1) 120.

As illustrated in FIG. 4A, in the cooling device 100 configuration is made such that when the first electromagnetic valve 120 of the first flow path 104 is opened and the second electromagnetic valve 122 of the bypass flow path 116 is closed, the liquid coolant flows in the first flow path 104 and is sent to the cooling flow path 210 (see FIG. 3A) of the first guide plate 72, and the liquid coolant then flows in the second flow path 106 and merges into the discharge side flow path 112. Namely cooling of the first guide plate 72 is started by opening the first electromagnetic valve 120 and sending the liquid coolant to the cooling flow path 210 (see FIG. 3A) of the first guide plate 72.

Figure 4B:
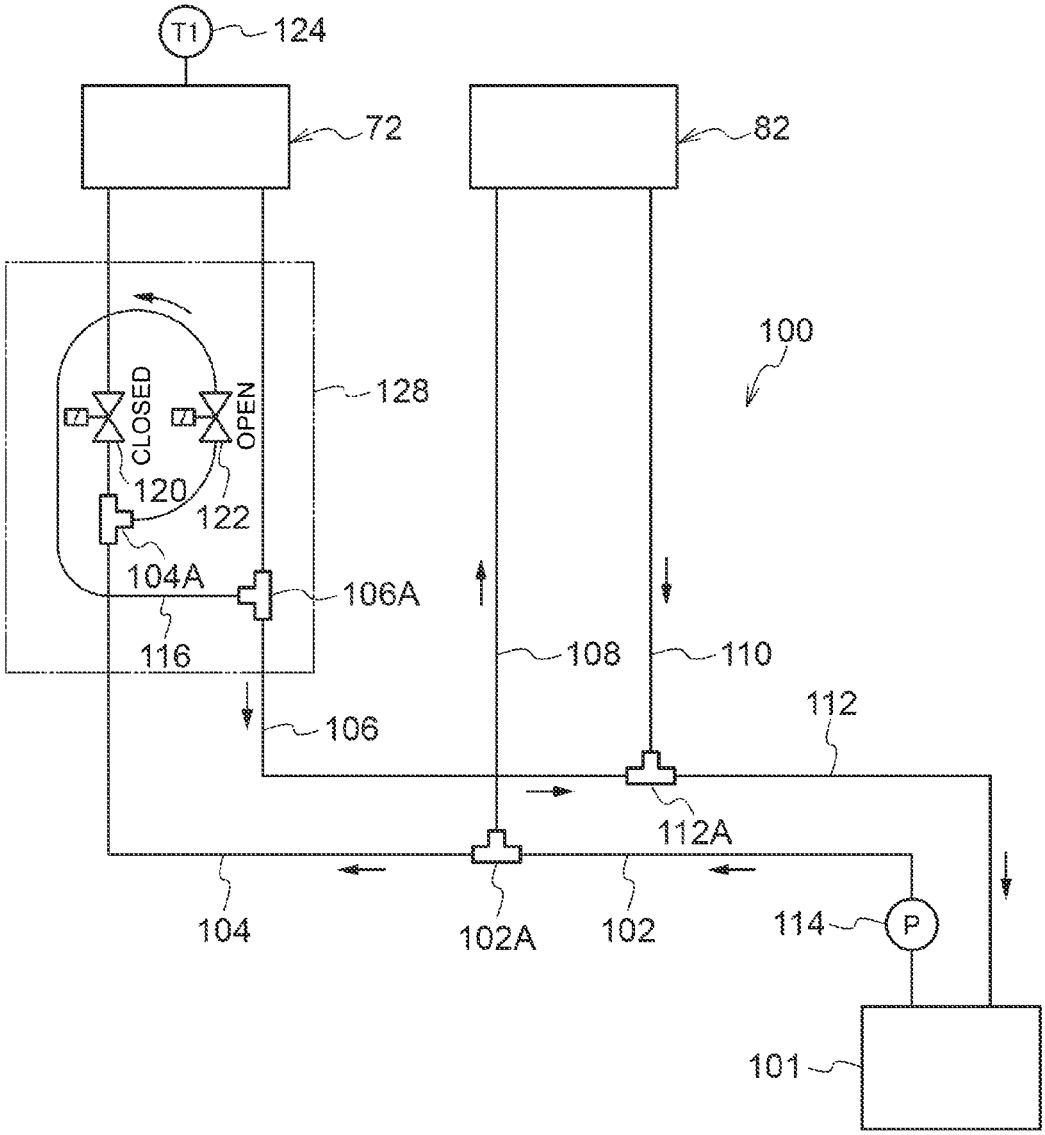
FIG. 4B is a configuration diagram illustrating a liquid coolant circulation device employed in the image forming apparatus illustrated in FIG. 1 in a state in which liquid coolant is being circulated in bypass flow path of the first guide member.

Moreover as illustrated in FIG. 4B, in the cooling device 100 configuration is made such that when the first electromagnetic valve 120 of the first flow path 104 is closed and the second electromagnetic valve 122 of the bypass flow path 116 is opened, the liquid coolant flows from the branch portion 104A of the first flow path 104 into the bypass flow path 116 and flows in the second flow path 106 from the merging portion 106A and is then merged into the discharge side flow path 112. Namely cooling of the first guide plate 72 is stopped due to the liquid coolant flowing from the branch portion 104A of the first flow path 104 through the bypass flow path 116, with the liquid coolant no longer being supplied to the cooling flow path 210 (see FIG. 3A) of the first guide plate 72.

As described above, in the cooling device 100 the temperature of the first guide plate 72 is controlled by intermittently circulating the liquid coolant to the cooling flow path 210 (see FIG. 3A) of the first guide plate 72.

In the present exemplary embodiment, when the temperature of the first guide plate 72 detected by the thermistor 124 has reached an upper limit setting temperature or above, control is made to open the first electromagnetic valve (CV1) 120 and close the second electromagnetic valve (CV2) 122. When the temperature of the first guide plate 72 detected by the thermistor 124 has reached a lower limit setting temperature, control is made to close the first electromagnetic valve (CV 1) 120 and open the second electromagnetic valve (CV2) 122. The temperature of the first guide plate 72 can accordingly be controlled to within a specific temperature range.

The controller 126 controls the second electromagnetic valve 122 of the bypass flow path 116 so as to open at the same time as the first electromagnetic valve 120 closes, or before the first electromagnetic valve 120 closes. The controller 126 also controls the second electromagnetic valve 122 of the bypass flow path 116 so as to close at the same time that the first electromagnetic valve 120 opens, or after the first electromagnetic valve 120 opens. This accordingly avoids a situation in which the second electromagnetic valve 122 and the first electromagnetic valve 120 being closed at the same time, preventing an increase in load due to the liquid coolant building up in the flow paths of the second electromagnetic valve 122 and the first electromagnetic valve 120.

The chiller body 101 is configured so as to circulate the liquid coolant at a uniform temperature and at a uniform flow rate. The bypass flow path 116 is provided between the first flow path 104 and the second flow path 106, and the second electromagnetic valve 122 is closed and opened coupled with the opening and closing of the first electromagnetic valve 120. The liquid coolant supplied to the first flow path 104 therefore either flows in the cooling flow path 210 (see FIG. 3A) of the first guide plate 72, or flows in the bypass flow path 116. A substantially uniform cooling circulation flow rate can accordingly be maintained for the second guide plate 82 even when the chiller body 101 circulates the liquid coolant at a uniform flow rate.

Note that in the present exemplary embodiment, the UV irradiation units 74 are configured so as to be air cooled rather than forcibly cooled by the liquid coolant.

Note that in the present exemplary embodiment, other flow rate control valves may be provided in place of the first electromagnetic valve 120 and the second electromagnetic valve 122.

Explanation follows regarding operation and advantageous effects of the cooling device 100 provided to the inkjet recording apparatus 10.

As illustrated in FIG. 4A, the flow of the liquid coolant sent from the chiller body 101 to the supply side flow path 102 is split between the first flow path 104 and the third flow path 108 by the branch portion 102A. The liquid coolant flowing in the first flow path 104 is supplied to the cooling flow path 210 (see FIG. 3A) of the first guide plate 72 by opening the first electromagnetic valve 120 of the first flow path 104 and closing the second electromagnetic valve 122 of the bypass flow path 116. The first guide plate 72 is thus cooled. The liquid coolant flowing in the third flow path 108 is supplied to the cooling flow path (not illustrated in the drawings) of the second guide plate 82. The second guide plate 82 is thus cooled.

The liquid coolant is discharged from the cooling flow path 210 (see FIG. 3A) of the first guide plate 72 into the second flow path 106. The liquid coolant in the cooling flow path (not illustrated in the drawings) of the second guide plate 82 is discharged into the fourth flow path 110. The liquid coolant flowing in the second flow path 106 and the liquid coolant flowing in the fourth flow path 110 is merged into the discharge side flow path 112 through the merging portion 112A and returned to the chiller body 101. The chiller body 101 circulates the liquid coolant at a uniform temperature and at a uniform flow rate.

In the inkjet recording apparatus 10 (see FIG. 1), the cooling method that is required in order to maintain performance is different for the first guide plate 72 and the second guide plate 82 that are plural cooling targets. In the present exemplary embodiment, the first guide plate 72 positioned to the lower side of the ink drying units 68 has to be regulated to within a specific temperature range for maintaining drying performance, so there is a need for temperature regulation by intermittent circulation of the liquid coolant. The second guide plate 82 positioned to the lower side of the UV irradiation units 74 has to be continuously cooled with liquid coolant at a uniform flow rate in order to maintain UV irradiation ink curing performance, and so there is a need for continuous circulation of the liquid coolant.

Generally, when cooling plural cooling targets with a single chiller, when liquid coolant is intermittently circulated to one of the cooling targets in order to perform temperature regulation, there is a possibility that the flow rate of the liquid coolant to other cooling targets may change.

In the present exemplary embodiment, the bypass flow path 116 is provided between the first flow path 104 and the second flow path 106, and the second electromagnetic valve 122 is closed and opened coupled with the opening and closing of the first electromagnetic valve 120. The liquid coolant supplied to the first flow path 104 accordingly either flows in the cooling flow path 210 (see FIG. 3A) of the first guide plate 72 or flows in the bypass flow path 116. A substantially uniform cooling circulation flow rate can accordingly be maintained for the second guide plate 82 even when the chiller body 101 circulates the liquid coolant at a uniform flow rate.

The controller 126 opens the first electromagnetic valve (CV1) 120 and closes the second electromagnetic valve (CV2) 122 when the temperature of the first guide plate 72 detected by the thermistor 124 has reached the upper limit setting temperature or above. The liquid coolant accordingly flows in the cooling flow path 210 of the first guide plate 72 at a uniform flow rate, cooling the first guide plate 72. The controller 126 closes the first electromagnetic valve (CV1) 120 and opens the second electromagnetic valve (CV2) 122 when the temperature of the first guide plate 72 detected by the thermistor 124 has reached the lower limit setting temperature. The liquid coolant accordingly flows in the bypass flow path 116 and cooling of the first guide plate 72 is stopped. The temperature of the first guide plate 72 can accordingly be controlled to within the specific temperature range even when the temperature of the first guide plate 72 rises due to heating by the ink drying units 68.

Since a substantially uniform cooling circulation flow rate is maintained for the second guide plate 82 when the first guide plate 72 is being cooled by intermittent circulation of the liquid coolant, the liquid coolant can be continuously circulated to the second guide plate 82 at a substantially uniform flow rate.

The second electromagnetic valve 122 of the bypass flow path 116 is controlled to open at the same time as the first electromagnetic valve 120 closes, or before the first electromagnetic valve 120 closes. The second electromagnetic valve 122 of the bypass flow path 116 is moreover controlled to close at the same time as the first electromagnetic valve 120 opens, or after the first electromagnetic valve 120 opens. This accordingly avoids a situation in which the second electromagnetic valve 122 and the first electromagnetic valve 120 are closed at the same time, enabling an increase in load due to the liquid coolant building up in the flow paths of the second electromagnetic valve 122 and the first electromagnetic valve 120 to be suppressed.

Note that there is no limitation of the configuration of the cooling flow path 210 of the first guide plate 72 to the substantially parallel back and forth snaking configuration of the present exemplary embodiment, and modification may be made thereto.

Second Exemplary Embodiment

Figure 6A:
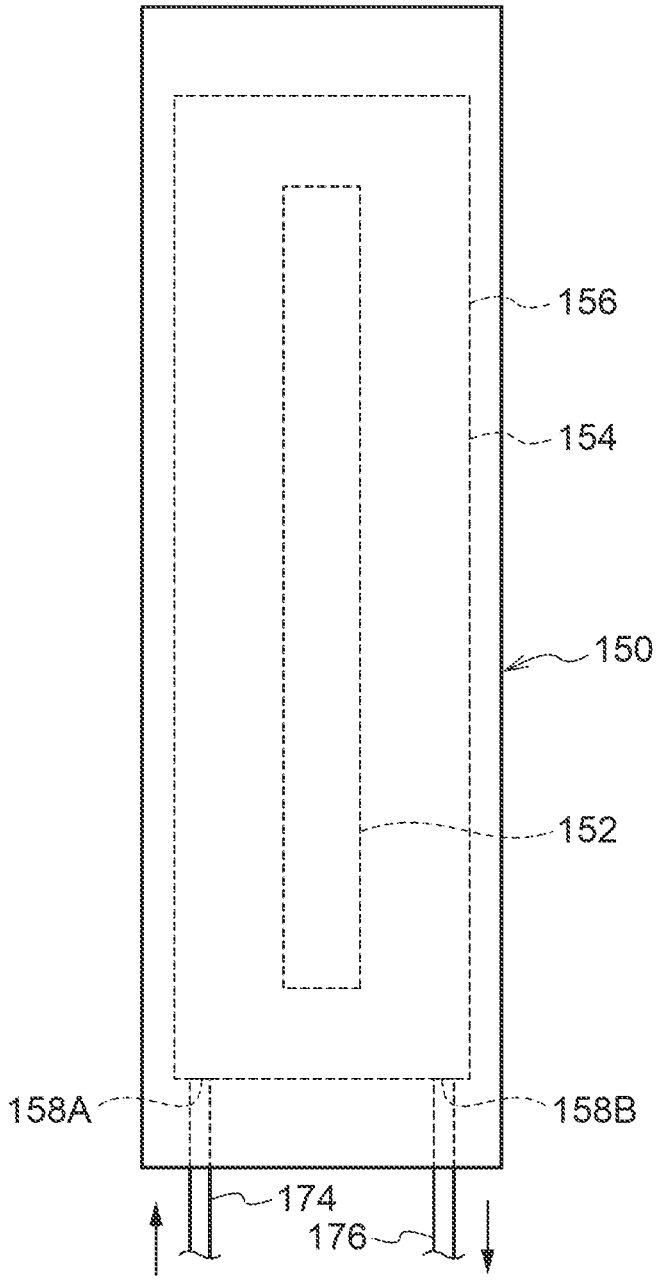
FIG. 6A is a plan view illustrating a UV irradiation unit employed in an image forming apparatus according to a second exemplary embodiment of the present invention.
Figure 6B:
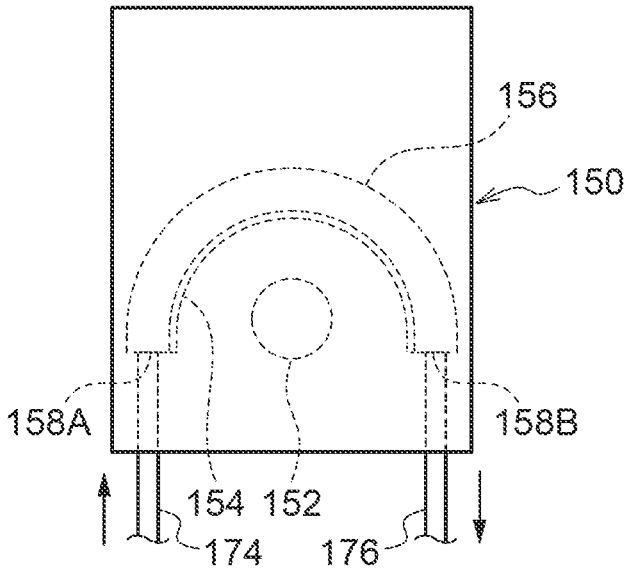
FIG. 6B is a side view of the UV irradiation unit illustrated in FIG. 6A.
Figure 7:
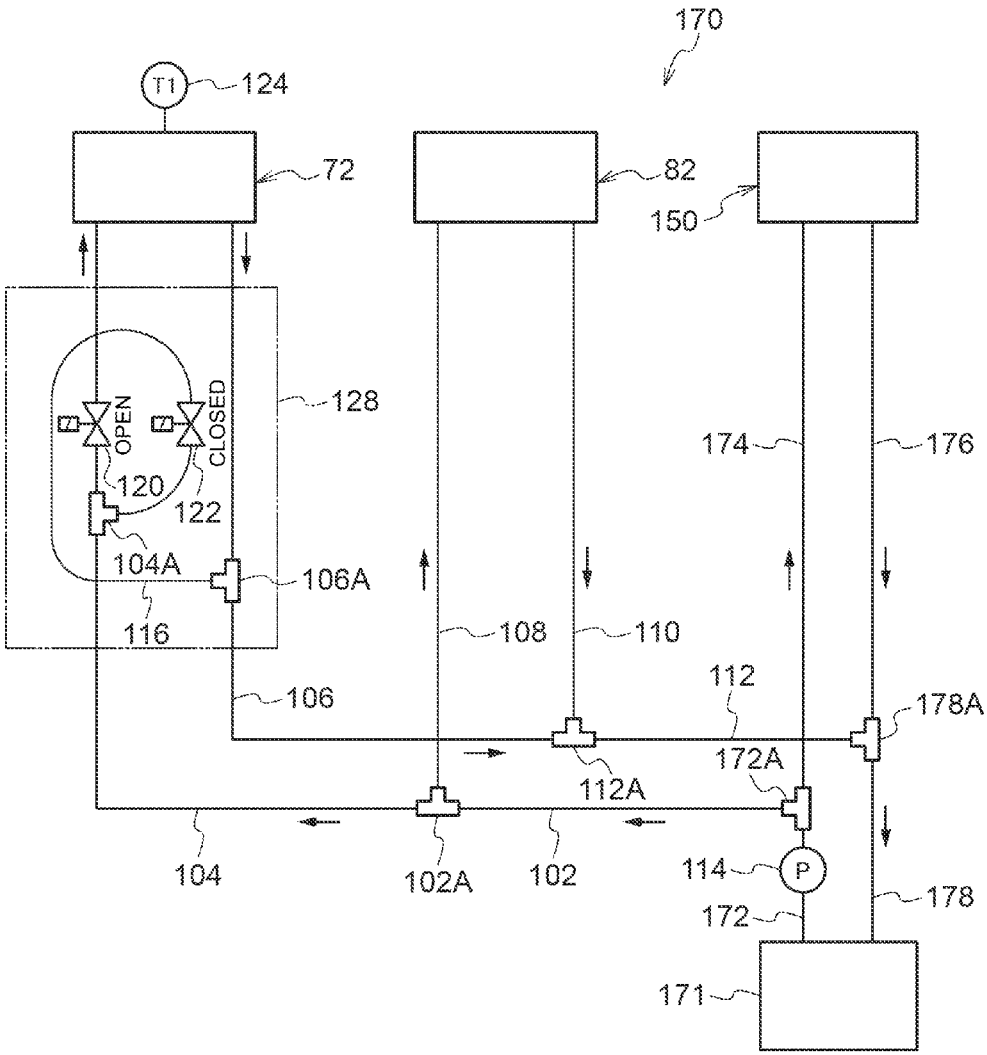
FIG. 7 is a configuration diagram illustrating a liquid coolant circulation device employed in an image forming apparatus of the second exemplary embodiment of the present invention in a state in which liquid coolant is being circulated in a cooling flow path of a first guide member.

Explanation follows regarding an inkjet recording apparatus serving as an image forming apparatus of a second exemplary embodiment of the present invention, with reference to FIG. 6A to FIG. 7. Note that configuration portions similar to those of the first exemplary embodiment described above are allocated the same reference numerals and explanation thereof is omitted.

FIG. 6A is a plan view illustrating a UV irradiation unit 150 employed in the inkjet recording apparatus of the second exemplary embodiment. FIG. 6B is a side view illustrating the UV irradiation unit 150. FIG. 7 illustrates a cooling device 170 that cools a first guide plate 72, a second guide plate 82 and the UV irradiation unit 150 that serve as plural (3 in the present exemplary embodiment) cooling targets. As illustrated in FIG. 6A and FIG. 6B, the UV irradiation unit 150 includes a UV (ultraviolet radiation) lamp 152 for irradiating ultraviolet radiation on to the front surface of the paper P (see FIG. 1), and a reflecting mirror 154 disposed so as to enclose a back face side (an opposite side to the irradiation direction) of the UV lamp 152. The reflecting mirror 154 is formed in a substantially semicircular shape, and is disposed at a specific separation to a peripheral surface of the UV lamp 152. The reflecting mirror 154 is disposed over substantially the entire region in the UV lamp 152 width direction.

The UV irradiation unit 150 further includes a cooling flow path 156 disposed along the reflecting mirror 154 on a back face side of the reflecting mirror 154 (on the opposite side to the UV lamp 152). Although not illustrated in the drawings, the cooling flow path 156 is for example configured by an elongated flow path that is disposed snaking back and forth over substantially the entire length of the reflecting mirror 154. A fifth flow path 174 that supplies liquid coolant to the cooling flow path 156 is connected to a connection port 158A that is one end portion of the cooling flow path 156. A sixth flow path 176 that discharges the liquid coolant from the cooling flow path 156 is connected to a connection port 158B that is another end portion of the cooling flow path 156. The liquid coolant flows in the cooling flow path 156, cooling the vicinity of the reflecting mirror 154 of the UV irradiation unit 150.

As illustrated in FIG. 7, the cooling device 170 includes a chiller body 171 serving as a single liquid coolant circulation device for circulating the liquid coolant. The cooling device 170 is configured so as to cool the first guide plate 72 that is one cooling target by intermittent circulation of the liquid coolant, and cool the second guide plate 82 and the UV irradiation unit 150 that are the other 2 cooling targets by continuous circulation of the liquid coolant.

More specifically, a single supply side flow path 172 for supplying the liquid coolant is connected to the chiller body 171, with the supply side flow path 172 branching into a supply side flow path 102 and the fifth flow path 174 at a branch portion 172A. The supply side flow path 102 branches into a first flow path 104 and a third flow path 108 at a branch portion 102A. The supply side flow path 172 is provided with a pump 114 for circulating the liquid coolant. The fifth flow path 174 is connected to the UV irradiation unit 150 (see FIG. 6A and FIG. 6B).

The sixth flow path 176 for discharging the liquid coolant is also connected to the UV irradiation unit 150 (see FIG. 6A and FIG. 6B). The second flow path 106 and the fourth flow path 110 merge into the single discharge side flow path 112 at a merging portion 112A. The discharge side flow path 112 and the sixth flow path 176 merge into a single discharge side flow path 178 at a merging portion 178A. The discharge side flow path 178 is connected to the chiller body 171.

In other words, the first flow path 104 and a second flow path 106 that are connected to the first guide plate 72, the third flow path 108 and a fourth flow path 110 that are connected to the second guide plate 82, and the fifth flow path 174 and the sixth flow path 176 that are connected to the UV irradiation unit 150 respectively configure circulation flow paths formed between the chiller body 171 and the first guide plate 72, the second guide plate 82 and the UV irradiation unit 150 that serve as plural cooling targets.

In the cooling device 170, the liquid coolant is continuously circulated due to connecting the fifth flow path 174 and the sixth flow path 176 to the cooling flow path 156 (see FIG. 6A and FIG. 6B) of the UV irradiation unit 150. The UV irradiation unit 150 is thus continuously cooled.

In the cooling device 170, a switching device 128 is provided between the first flow path 104 and the second flow path 106 for cooling the first guide plate 72 by intermittent circulation of the liquid coolant.

The chiller body 171 is configured to circulate the liquid coolant at a uniform temperature and at a uniform flow rate. A bypass flow path 116 is provided between the first flow path 104 and the second flow path 106, and a second electromagnetic valve 122 is closed and opened coupled with the opening and closing of a first electromagnetic valve 120. The liquid coolant supplied to the first flow path 104 accordingly either flows in the cooling flow path 210 (see FIG. 3A) of the first guide plate 72 or flows in the bypass flow path 116. A substantially uniform continuous circulation flow rate of the liquid coolant can accordingly be maintained for the second guide plate 82 and the UV irradiation unit 150 even when the chiller body 171 circulates the liquid coolant at a uniform flow rate.

For example, when the temperature of the first guide plate 72 detected by the thermistor 124 has reached the upper limit setting temperature or above, the first electromagnetic valve (CV1) 120 is opened, and the second electromagnetic valve (CV2) 122 is closed (see FIG. 7). The liquid coolant accordingly flows in the cooling flow path 210 (see FIG. 3A) of the first guide plate 72 at a uniform flow rate, cooling the first guide plate 72. When the temperature of the first guide plate 72 detected by the thermistor 124 has reached the lower limit setting temperature, the first electromagnetic valve (CV1) 120 is closed and the second electromagnetic valve (CV2) 122 is opened. The liquid coolant accordingly flows in the bypass flow path 116, stopping cooling of the first guide plate 72. The temperature of the first guide plate 72 can accordingly be controlled to within the specific temperature range.

Since a substantially uniform liquid coolant flow rate is maintained in the continuous circulation to the second guide plate 82 and the UV irradiation unit 150 when the first guide plate 72 is being cooled by intermittent circulation of the liquid coolant, the liquid coolant can be continuously circulated to the second guide plate 82 and the UV irradiation unit 150 at a substantially uniform flow rate.

Third Exemplary Embodiment

Figure 8:
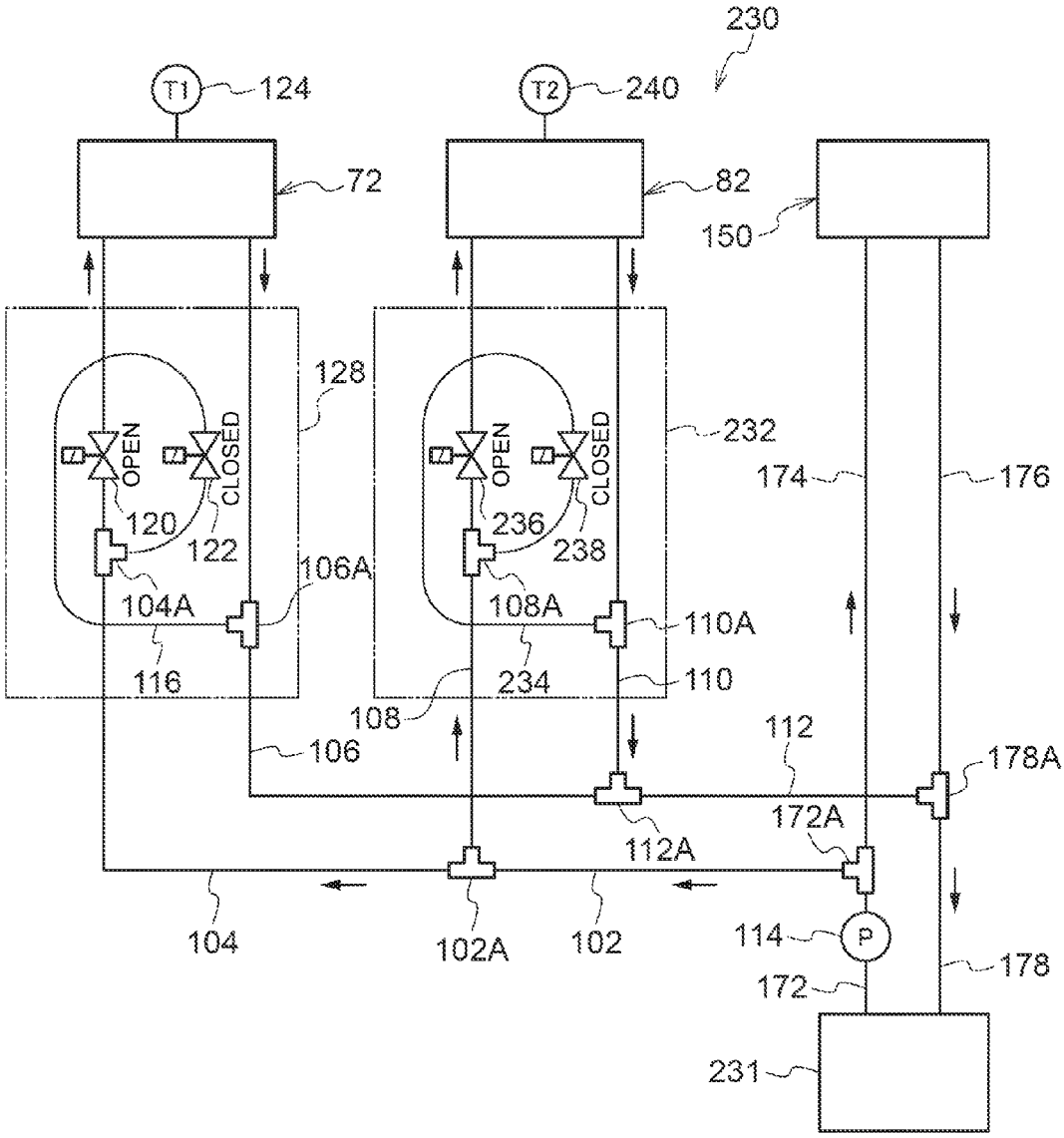
FIG. 8 is a configuration diagram illustrating a liquid coolant circulation device employed an image forming apparatus of a third exemplary embodiment of the present invention in a state in which liquid coolant is being circulated in a cooling flow path of a first guide member and a cooling flow path of a second guide member.

Explanation follows regarding an inkjet recording apparatus serving as an image forming apparatus of a third exemplary embodiment of the present invention, with reference to FIG. 8. Note that configuration portions similar to those of the first exemplary embodiment and the second exemplary embodiment described above are allocated the same reference numerals and explanation thereof is omitted.

FIG. 8 illustrates a cooling device 230 that cools a first guide plate 72, a second guide plate 82 and a UV irradiation unit 150 that serve as plural (3 in the present exemplary embodiment) cooling targets of the inkjet recording apparatus. As illustrated in FIG. 8, the cooling device 230 includes a chiller body 231 serving as a single liquid coolant circulation device for circulating liquid coolant. The cooling device 230 is configured so as to cool two of the cooling targets, these being the first guide plate 72 and the second guide plate 82, by intermittent circulation of the liquid coolant, and cool one other cooling target, that is the UV irradiation unit 150, by continuous circulation of the liquid coolant.

A switching device 232 is provided to the cooling device 230 between the third flow path 108 and the fourth flow path 110 for cooling the second guide plate 82 by intermittent circulation of the liquid coolant. More specifically, a branch portion 108A is provided partway along the third flow path 108 serving as an inflow flow path, and one end of a bypass flow path 234 is connected to the branch portion 108A. A merging portion 110A is provided partway along the fourth flow path 110 serving as a return flow path, with the other end of the bypass flow path 234 connected to the merging portion 110A. In other words, the bypass flow path 234 is connected between the third flow path 108 and the fourth flow path 110 that are intermittent circulation flow paths, and are connected so as to bypass the cooling flow path (not illustrated in the drawings) of the second guide plate 82 that is a cooling target.

A third electromagnetic valve 236 serving as a first opening and closing valve is provided to the third flow path 108 on the second guide plate 82 side of the branch portion 108A where the bypass flow path 234 branches off. A fourth electromagnetic valve 238 serving as a second opening and closing valve is provided to the bypass flow path 234. In other words, the third electromagnetic valve 236 and the fourth electromagnetic valve 238 configure an opening and closing portion of the present invention, with the fourth electromagnetic valve 238 being closed and opened coupled to the opening and closing of the third electromagnetic valve 236. Switching can accordingly be made between a route in which the liquid coolant circulates through the cooling flow path (not illustrated in the drawings) of the second guide plate 82 and a route in which the liquid coolant circulates through the bypass flow path 234.

A thermistor (T2) 240 serving as a temperature detection sensor is provided to the second guide plate 82. In the present exemplary embodiment, the thermistor 240 for example detects the temperature of the upper face of the second guide plate 82.

The chiller body 231 is configured so as to circulate the liquid coolant at a uniform temperature and at a uniform flow rate. In the present exemplary embodiment, the bypass flow path 116 is provided between the first flow path 104 and the second flow path 106 and the second electromagnetic valve 122 is closed and opened coupled with the opening and closing of the first electromagnetic valve 120. The bypass flow path 234 is provided between the third flow path 108 and the fourth flow path 110, and the fourth electromagnetic valve 238 is closed and opened coupled with the opening and closing of the third electromagnetic valve 236. The liquid coolant supplied to the first flow path 104 thereby either flows in the cooling flow path 210 (see FIG. 3A) of the first guide plate 72 or flows in the bypass flow path 116. The liquid coolant supplied to the third flow path 108 either flows in the cooling flow path (not illustrated in the drawings) of the second guide plate 82 or flows in the bypass flow path 234. A substantially uniform liquid coolant flow rate can accordingly be maintained for continuous circulation to the UV irradiation unit 150 even when the liquid coolant is being circulated at a uniform flow rate by the chiller body 231.

In the present exemplary embodiment, when the temperature of the second guide plate 82 detected by the thermistor 240 has reached a upper limit setting temperature or above, control is made to open the third electromagnetic valve 236 and close the fourth electromagnetic valve 238. When the temperature of the second guide plate 82 detected by the thermistor 240 has reached a lower limit setting temperature, control is made to close the third electromagnetic valve 236 and open the fourth electromagnetic valve 238. The temperature of the second guide plate 82 can accordingly be controlled to within a specific temperature range.

Moreover, in the present exemplary embodiment, the fourth electromagnetic valve 238 of the bypass flow path 234 is controlled so as to open at the same time as the third electromagnetic valve 236 closes, or to open before the third electromagnetic valve 236 closes. The fourth electromagnetic valve 238 of the bypass flow path 234 is moreover controlled so as to close at the same time as the third electromagnetic valve 236 opens, or to close after the third electromagnetic valve 236 opens. This accordingly avoids a situation in which the fourth electromagnetic valve 238 and the third electromagnetic valve 236 are closed at the same time, enabling an increase in load due to the liquid coolant building up in the flow paths of the fourth electromagnetic valve 238 and the third electromagnetic valve 236 to be suppressed.

In the thus configured cooling device 230, since a substantially uniform liquid coolant flow rate is maintained for the continuous circulation to the UV irradiation unit 150 when the first guide plate 72 and the second guide plate 82 are being cooled by intermittent circulation of the liquid coolant, the liquid coolant can be continuously circulated to the UV irradiation unit 150 at a substantially uniform flow rate.

Explanation has been given above regarding exemplary embodiments of the present invention, however the present invention is not limited by any of the above exemplary embodiments, and obviously various embodiments may be implemented within a range not departing from the spirit of the present invention.

Note that there is no limitation to the cooling targets of the first exemplary embodiment to the third exemplary embodiment, and configuration may be made wherein intermittently circulated and continuously circulated to other additional cooling targets by a single liquid coolant circulation device.

In the inkjet recording apparatus 10 of the first exemplary embodiment to the third exemplary embodiment, the first opening and closing valve is provided to the first flow path (inflow flow path) connected to the first guide plate, and the second opening and closing valve is provided to the bypass flow path connecting together the first flow path (inflow flow path) and the second flow path (return flow path), however there is no limitation thereto. For example, configuration may be made wherein an opening and closing portion (such as an opening and closing valve) that opens and closes is provided to a circulation flow path (such as the first flow path) connected to the first guide plate, and a bypass flow path is omitted. By opening and closing the opening and closing portion, such a configuration still allows a single chiller body (liquid coolant circulation device) to cool the first guide plate by intermittent circulation of the liquid coolant, and cool the second guide plate and/or the UV irradiation unit by continuous circulation of the liquid coolant.

In the inkjet recording apparatus 10, configuration is made such that the ink drying units dry the paper P whilst the paper P is being conveyed by the chain gripper 64, and the UV irradiation units cure the ink on the paper P, however there is no limitation thereto. Configuration may be made wherein the paper P is dried by the ink drying units 68 that are disposed facing a drum (impression cylinder) and the ink on the paper P is cured by the UV irradiation units whilst the paper P is being conveyed by the drum (impression cylinder). In such a configuration, the drum (impression cylinder) serves as a cooling target.

What is claimed is:

1. An image forming apparatus comprising:

at least two guide members that guide a conveyed recording medium;

a drying section that is disposed facing one of the guide members and that dries ink that has been jetted onto the recording medium;

an ink curing section that is disposed facing another of the guide members and that illuminates light onto a front surface of the recording medium that has been dried by the drying section and cures the ink;

a single liquid coolant circulation device that circulates liquid coolant to respectively formed circulation flow paths between the liquid coolant circulation device and a plurality of cooling targets for which cooling is required due to heat of the drying section or heat of the ink curing section, that cools one of the cooling targets with intermittent circulation of liquid coolant, and that cools another of the cooling targets with continuous circulation of liquid coolant; and an opening and closing portion that opens and closes one of the circulation flow paths to intermittently circulate the liquid coolant of the one cooling target.

2. The image forming apparatus of claim 1, further comprising:

a chain gripper that grips a leading edge of the recording medium and that conveys the recording medium along the guide members; and a suction adhesion portion that suction adheres the recording medium to the guide member.

3. The image forming apparatus of claim 1, further comprising:

a bypass flow path connecting together an inflow flow path and a return flow path configuring the one circulation flow path;

wherein the opening and closing portion is configured so as to switch the liquid coolant between a route in which the liquid coolant circulates through the one cooling target, and a route in which the liquid coolant circulates through the bypass flow path.

4. The image forming apparatus of claim 3, wherein the opening and closing portion comprises a first opening and closing valve provided to the inflow flow path further to the cooling target side than a connection portion between the inflow flow path and the bypass flow path, and a second opening and closing valve provided to the bypass flow path.

5. The image forming apparatus of claim 4, wherein:

when stopping cooling of the one cooling target, the second opening and closing valve is opened at the same time as or before the first opening and closing valve is closed; and when starting cooling of the one cooling target, the second opening and closing valve is closed at the same time as or after the first opening and closing valve is opened.

6. The image forming apparatus of claim 1, wherein:

the one cooling target is one of the guide members; and the other cooling target is another of the guide members or the ink curing section, or the other cooling target is another of the guide members and the ink curing section.

7. The image forming apparatus of claim 6, wherein:

the guide member provided facing the drying section is cooled by the intermittent circulation; and the guide member provided facing the ink curing section is cooled by the continuous circulation.

8. The image forming apparatus of claim 4, further comprising:

a temperature detection sensor that detects the temperature of one of the guide members;

wherein the temperature of the guide member is controlled by the intermittent circulation based on a detection temperature of the temperature detection sensor.

9. The image forming apparatus of claim 8, wherein control is made such that:

the first opening and closing valve is opened and the second opening and closing valve is closed when the temperature of the guide member has reached an upper limit setting temperature or above; and the first opening and closing valve is closed and the second opening and closing valve is opened when the temperature of the guide member has reached a lower limit setting temperature.

* * * * *